US010522945B2

(12) United States Patent
Schneider et al.

(10) Patent No.: US 10,522,945 B2
(45) Date of Patent: Dec. 31, 2019

(54) ELECTRICAL CONNECTOR

(71) Applicant: Interplex Industries, Inc., East Providence, RI (US)

(72) Inventors: Richard Schneider, Livonia, MI (US); James M. Pick, Elk Grove Village, IL (US); Keith S. Maranto, Frankfort, IL (US)

(73) Assignee: INTERPLEX INDUSTRIES, INC., East Providence, RI (US)

( * ) Notice: Subject to any disclaimer, the term of this patent is extended or adjusted under 35 U.S.C. 154(b) by 0 days.

(21) Appl. No.: 16/190,809

(22) Filed: Nov. 14, 2018

(65) Prior Publication Data

US 2019/0081439 A1 Mar. 14, 2019

Related U.S. Application Data

(63) Continuation-in-part of application No. PCT/US2017/047800, filed on Aug. 21, 2017.
(Continued)

(51) Int. Cl.
*H01R 4/48* (2006.01)
*H01R 13/631* (2006.01)
(Continued)

(52) U.S. Cl.
CPC ..... *H01R 13/6315* (2013.01); *H01R 12/585* (2013.01); *H01R 12/7082* (2013.01);
(Continued)

(58) Field of Classification Search
CPC ..... H01H 1/42; H01R 13/6315
(Continued)

(56) References Cited

U.S. PATENT DOCUMENTS 1,978,246 A * 10/1934 Bauerschmidt ..... H01H 1/42 200/255
2,751,471 A * 6/1956 Wills ..... H01H 1/42 200/254
(Continued)

FOREIGN PATENT DOCUMENTS

CN 203250889 U 10/2013
DE 102013105148 A1 11/2014
(Continued)

OTHER PUBLICATIONS

Communication Relating to the Results of the Partial International Search, dated Jan. 30, 2019, from PCT/US2018/061521, filed on Nov. 16, 2018.
(Continued)

*Primary Examiner* — Neil Abrams
(74) *Attorney, Agent, or Firm* — Preti Flaherty Beliveau & Pachios LLP

(57) ABSTRACT

A connector for connection to a substrate for mounting electronic devices. The connector includes a stack of coupling contacts pivotably disposed within a housing. Each coupling contact is generally H-shaped and defines opposing first and second spaces. The first and second spaces are aligned to form first and second receiving grooves in the stack, respectively. The connector also includes one or more mounting contacts partially disposed within the housing. Each mounting contact has a fastening structure joined to a bar section. The fastening structure is adapted for securement to the substrate and the bar section is disposed in the second receiving groove of the stack of coupling contacts.

20 Claims, 19 Drawing Sheets

Related U.S. Application Data

(60) Provisional application No. 62/588,593, filed on Nov. 20, 2017, provisional application No. 62/377,859, filed on Aug. 22, 2016.

(51) Int. Cl.

| | |
|---|---|
| ***H01R 12/71*** | (2011.01) |
| ***H01R 13/10*** | (2006.01) |
| ***H01R 12/58*** | (2011.01) |
| ***H01R 12/70*** | (2011.01) |
| ***H01R 12/91*** | (2011.01) |
| ***H01R 13/11*** | (2006.01) |
| ***H01R 13/42*** | (2006.01) |
| *H01R 12/73* | (2011.01) |

(52) U.S. Cl.
CPC ..... *H01R 12/716* (2013.01); *H01R 12/91* (2013.01); *H01R 13/10* (2013.01); *H01R 13/112* (2013.01); *H01R 13/42* (2013.01); *H01R 12/707* (2013.01); *H01R 12/7023* (2013.01); *H01R 12/73* (2013.01)

(58) Field of Classification Search
USPC ..... 439/819, 247, 248
See application file for complete search history.

(56) References Cited

U.S. PATENT DOCUMENTS

| | | | | |
|---|---|---|---|---|
| 2,872,659 | A * | 2/1959 | Wills | H01H 1/42 439/819 |
| 2,892,659 | A * | 6/1959 | Augustin | B60P 1/04 298/22 R |
| 3,201,556 | A * | 8/1965 | Baird | H01H 1/42 439/251 |
| 4,121,067 | A * | 10/1978 | Rexroad | H01H 1/42 200/255 |
| 4,423,917 | A | 1/1984 | Scheingold et al. | |
| 4,453,792 | A | 6/1984 | Bright et al. | |
| 4,486,636 | A * | 12/1984 | Prietzel | H01H 1/42 200/255 |
| 4,616,893 | A | 10/1986 | Feldman | |
| 4,749,357 | A | 6/1988 | Foley | |
| 4,907,979 | A | 3/1990 | Feldman | |
| 5,052,953 | A * | 10/1991 | Weber | H01R 12/718 439/637 |
| 5,098,318 | A * | 3/1992 | Suter | H02B 11/04 200/255 |
| 5,139,426 | A | 8/1992 | Barkus et al. | |
| 5,156,552 | A | 10/1992 | Zaderej et al. | |
| 5,320,541 | A | 6/1994 | Korsunsky et al. | |
| 5,431,576 | A | 7/1995 | Matthews | |
| D372,220 | S | 7/1996 | Matthews | |
| 5,813,883 | A | 9/1998 | Lin | |
| D411,173 | S | 6/1999 | Chau et al. | |
| 6,299,492 | B1 | 10/2001 | Pierini et al. | |
| 6,319,021 | B1 | 11/2001 | Billman | |
| 6,431,891 | B1 | 8/2002 | Billman | |
| 6,604,967 | B2 | 8/2003 | Middlehurst et al. | |
| 6,722,926 | B2 | 4/2004 | Chevassus-More | |
| 6,923,661 | B1 | 8/2005 | Bogiel et al. | |
| 6,974,337 | B2 | 12/2005 | Belopolsky et al. | |
| 7,258,562 | B2 | 8/2007 | Daily et al. | |
| 7,303,401 | B2 | 12/2007 | Schell et al. | |
| 7,314,377 | B2 | 1/2008 | Northey et al. | |
| 7,374,436 | B2 | 5/2008 | Schell et al. | |
| 7,581,972 | B2 | 9/2009 | Daamen | |
| 7,806,711 | B2 | 10/2010 | Andersen et al. | |
| 7,905,729 | B2 | 3/2011 | Goosens | |
| 7,976,317 | B2 * | 7/2011 | Patel | H01R 12/7088 439/699.1 |
| 8,043,097 | B2 * | 10/2011 | Ngo | H01R 12/7088 439/206 |
| 8,053,669 | B1 | 11/2011 | Sodini et al. | |
| 8,096,814 | B2 | 1/2012 | Schell et al. | |
| 8,182,299 | B2 | 5/2012 | Schrader | |
| 8,187,017 | B2 | 5/2012 | Daily et al. | |
| 8,197,289 | B1 | 6/2012 | Faber et al. | |
| 8,360,789 | B2 | 1/2013 | Yin et al. | |
| 8,388,389 | B2 | 3/2013 | Costello et al. | |
| 8,419,441 | B1 | 4/2013 | Topolewski et al. | |
| 8,460,009 | B1 | 6/2013 | Topolewski et al. | |
| 8,690,586 | B2 | 4/2014 | Schneider | |
| 8,734,167 | B2 | 5/2014 | Aimoto | |
| 8,795,001 | B1 | 8/2014 | Lam et al. | |
| 8,979,562 | B2 | 3/2015 | Crighton et al. | |
| 8,998,618 | B2 * | 4/2015 | Hashiguchi | H01R 13/113 439/12 |
| 9,054,456 | B2 * | 6/2015 | Orris | H01R 13/112 |
| 9,070,990 | B2 | 6/2015 | Flickinger et al. | |
| 9,136,625 | B2 * | 9/2015 | Yu | H01R 12/724 |
| 9,257,804 | B1 | 2/2016 | Beck et al. | |
| 9,331,409 | B2 | 5/2016 | Naganuma et al. | |
| 9,337,597 | B2 | 5/2016 | Daamen et al. | |
| 9,379,468 | B2 | 6/2016 | Ziemen et al. | |
| 9,419,356 | B2 | 8/2016 | Copper et al. | |
| 9,478,889 | B2 | 10/2016 | Oshida | |
| 9,559,453 | B1 | 1/2017 | Luo | |
| 9,564,696 | B2 | 2/2017 | Gulla | |
| 9,577,359 | B2 | 2/2017 | Streckewald | |
| 9,680,236 | B2 | 6/2017 | Ngo | |
| 9,871,309 | B2 | 1/2018 | Gao et al. | |
| 10,128,624 | B2 * | 11/2018 | Tyler | H01R 13/447 |
| 2012/0156909 | A1 * | 6/2012 | Tyler | H01R 13/112 439/259 |
| 2016/0093963 | A1 | 3/2016 | Streckewald | |
| 2016/0322720 | A1 | 11/2016 | Gao et al. | |
| 2017/0324201 | A1 | 11/2017 | Schepis et al. | |
| 2018/0254573 | A1 | 9/2018 | Copper et al. | |
| 2018/0301834 | A1 | 10/2018 | Dandl et al. | |
| 2019/0081439 | A1 * | 3/2019 | Schneider | H01R 13/6315 |

FOREIGN PATENT DOCUMENTS

| | | | |
|---|---|---|---|
| WO | 2014/172250 | A1 | 10/2014 |
| WO | 2017/044653 | A1 | 3/2017 |
| WO | 2018/039123 | A1 | 3/2018 |

OTHER PUBLICATIONS

Presentation entitled "BarKlip BK300 Connector Product Presentation", FCI, Nov. 2015.

International Search Report and the Written Opinion of the International Searching Authority, dated Oct. 27, 2017, for PCT/US2017/47800, filed Aug. 21, 2017.

* cited by examiner

ELECTRICAL CONNECTOR

CROSS-REFERENCE TO RELATED APPLICATION(S)

This application claims the benefit of priority under 35 U.S.C. § 119(e) to Provisional Patent Application No.: 62/588,593, filed on Nov. 20, 2017, and is also a Continuation-In-Part of of International Patent Application No. PCT/US2017/047800, filed on Aug. 21, 2017, which claims priority to Provisional Patent Application No. 62/377,859, filed on Aug. 22, 2016, all of the foregoing applications being herein incorporated by reference.

TECHNICAL FIELD

The present disclosure relates to an electrical connector for connecting electronic and/or electrical parts that may be misaligned.

BACKGROUND

In an electronic/electric system, it is necessary to establish electrical connections between constituent parts of the system. Often, these parts are relatively rigid and have fixed locations where the parts are to be connected together. For example, the parts that are to be connected together may be printed circuit boards (PCBs) and the connection locations may be plated through-holes in the PCBs. While each PCB may be produced in compliance with strict tolerances, the connection locations between the PCBs may nonetheless become misaligned due to tolerance stacking or other reasons.

A misalignment between the connection locations of parts can cause mating problems when the parts are connected together (or attempted to be connected together). For example, as set forth above, one or both of the parts may be a PCB with plated through-holes as connection points. In such a situation, a connector is typically secured to the through-holes using soldering or press-fit connections. Such connections, which are rigid and relatively fragile, can be physically damaged by errant forces that are produced when the misaligned parts are brought together. Even if the parts are not damaged, the electrical connections may not be as robust as they should be, due to the misalignment.

Based on the foregoing, it would be desirable to provide an electrical connector for electrically connecting parts, wherein the connector accommodates misalignment between the parts.

SUMMARY

In accordance with the disclosure, a connector is provided for connection to a substrate for mounting electronic devices and/or electrical devices. The connector includes a housing having opposing first and second ends with openings, respectively, and a plurality of wall structures. At least a first one of the wall structures has an abutment surface located inwardly from the second end. A plurality of coupling contacts are disposed within the housing. Each of the coupling contacts includes a pair of elements having opposing first and second end portions, respectively. The elements in each pair are joined together, intermediate the first and second end portions. The first end portions are separated by a first space and the second end portions are separated by a second space. The coupling contacts are arranged serially in the housing such that the first spaces are aligned to form a first receiving groove disposed at the first end of the housing and the second spaces are aligned to form a second receiving groove disposed at the second end of the housing. A mounting contact extends into the housing and has a bar section joined to a fastening structure that is adapted for securement to the substrate. The bar section adjoins the abutment surface of the housing and is at least partially disposed in the second receiving groove formed by the coupling contacts.

Also provided in accordance with the disclosure is a coupler for connecting a rigid structure to a substrate for mounting electronic devices and/or electrical devices. The coupler includes a plastic housing having opposing first and second ends with openings, respectively, and a plurality of wall structures. A first one of the wall structures has a snap-fit projection joined thereto and extending therefrom. The snap-fit projection is adapted for securement within an opening in the substrate. A plurality of coupling contacts is disposed within the housing. Each of the coupling contacts includes a pair of elements having opposing first and second end portions, respectively. The elements in each pair are joined together, intermediate the first and second end portions. The first end portions are separated by a first space and the second end portions are separated by a second space. The coupling contacts are arranged serially in the housing such that the second spaces are aligned to form a second receiving groove disposed at the second end of the housing and the first spaces are aligned to form a first receiving groove disposed at the first end of the housing. The first receiving groove is adapted to receive the rigid structure therein.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
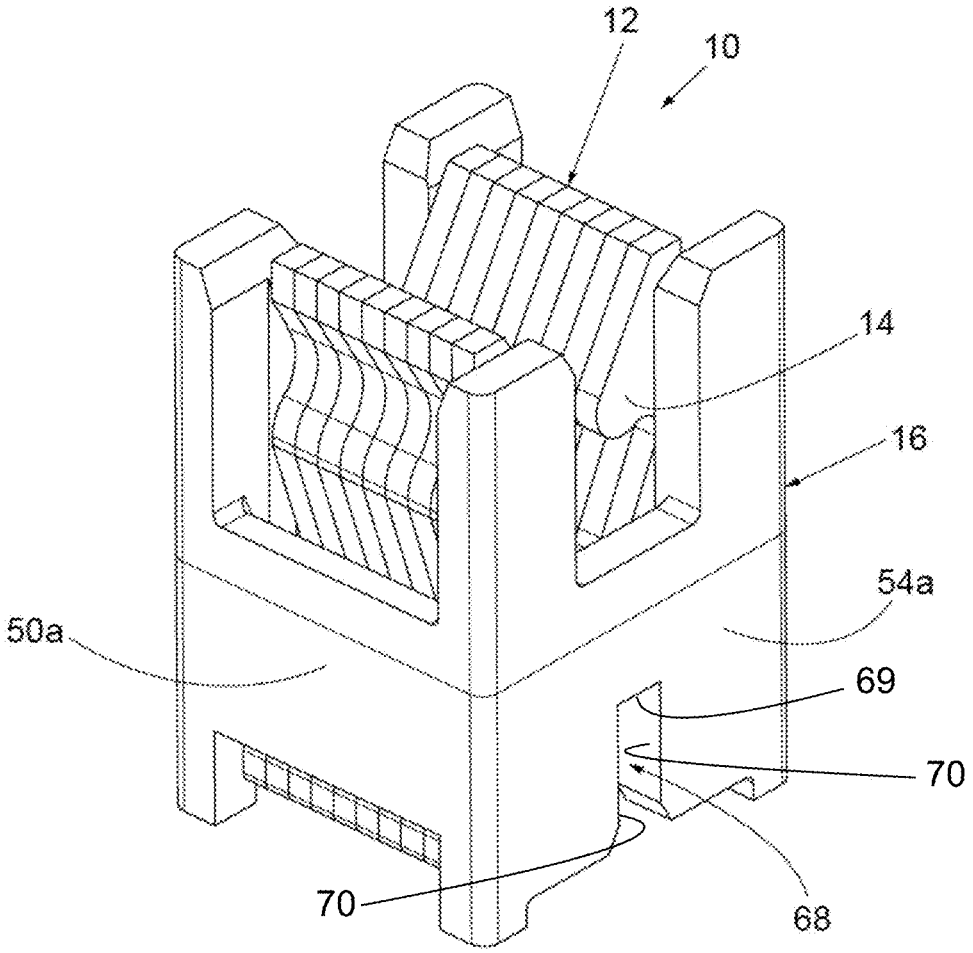
FIG. 1 shows a perspective view of a coupler of the disclosure.

It should be noted that in the detailed descriptions that follow, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

Spatially relative terms, such as "top", "bottom", "lower", "above", "upper", and the like, are used herein merely for ease of description to describe one element or feature's relationship to another element(s) or feature(s) as they are illustrated in (a) drawing figure(s) being referred to. It will be understood that the spatially relative terms are not meant to be limiting and are intended to encompass different orientations of the device in use or operation in addition to the orientation depicted in the drawings.

Figure 2:
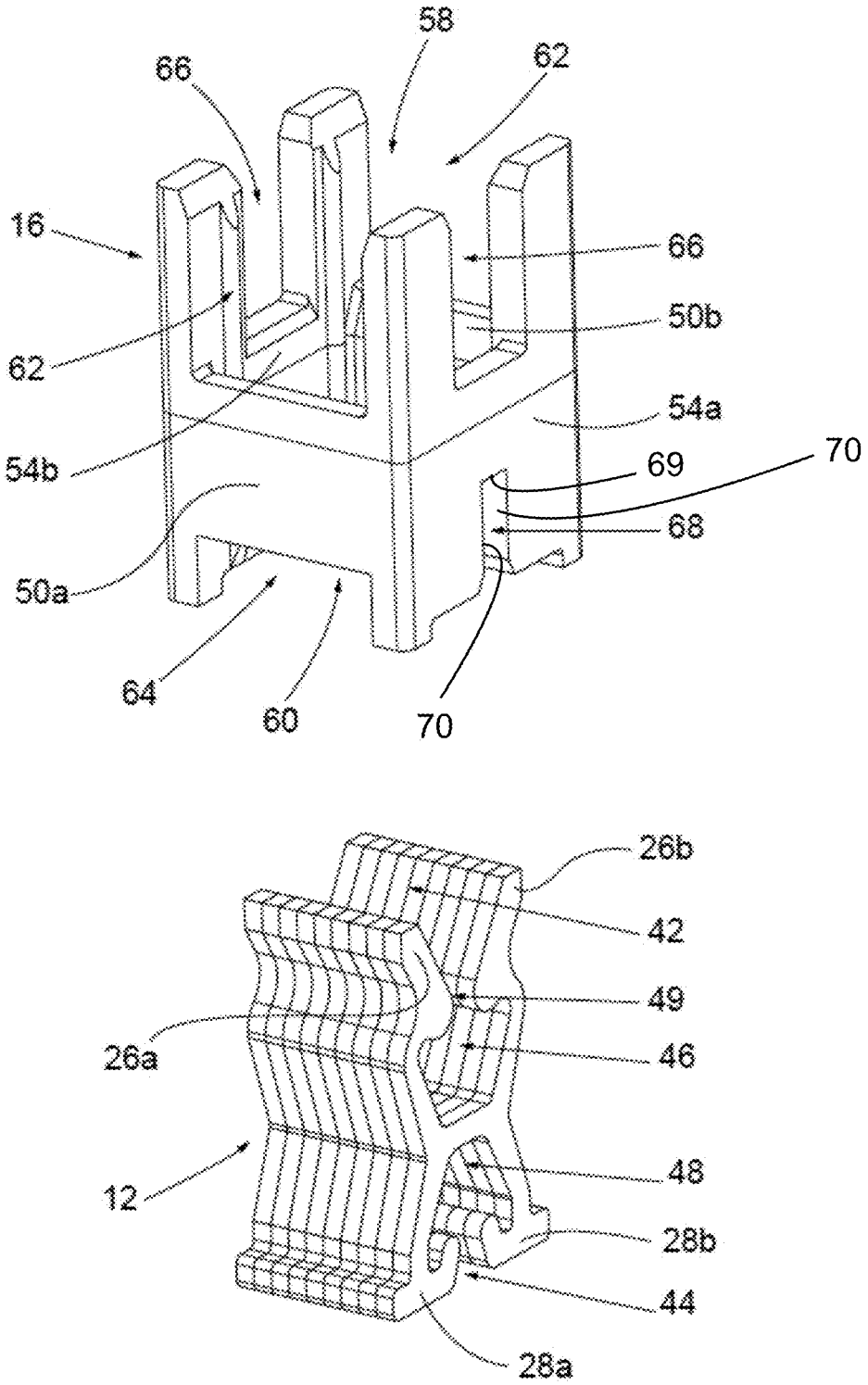
FIG. 2 shows a partially disassembled perspective view of the coupler with a stack of contact plates removed from a housing.
Figure 3:
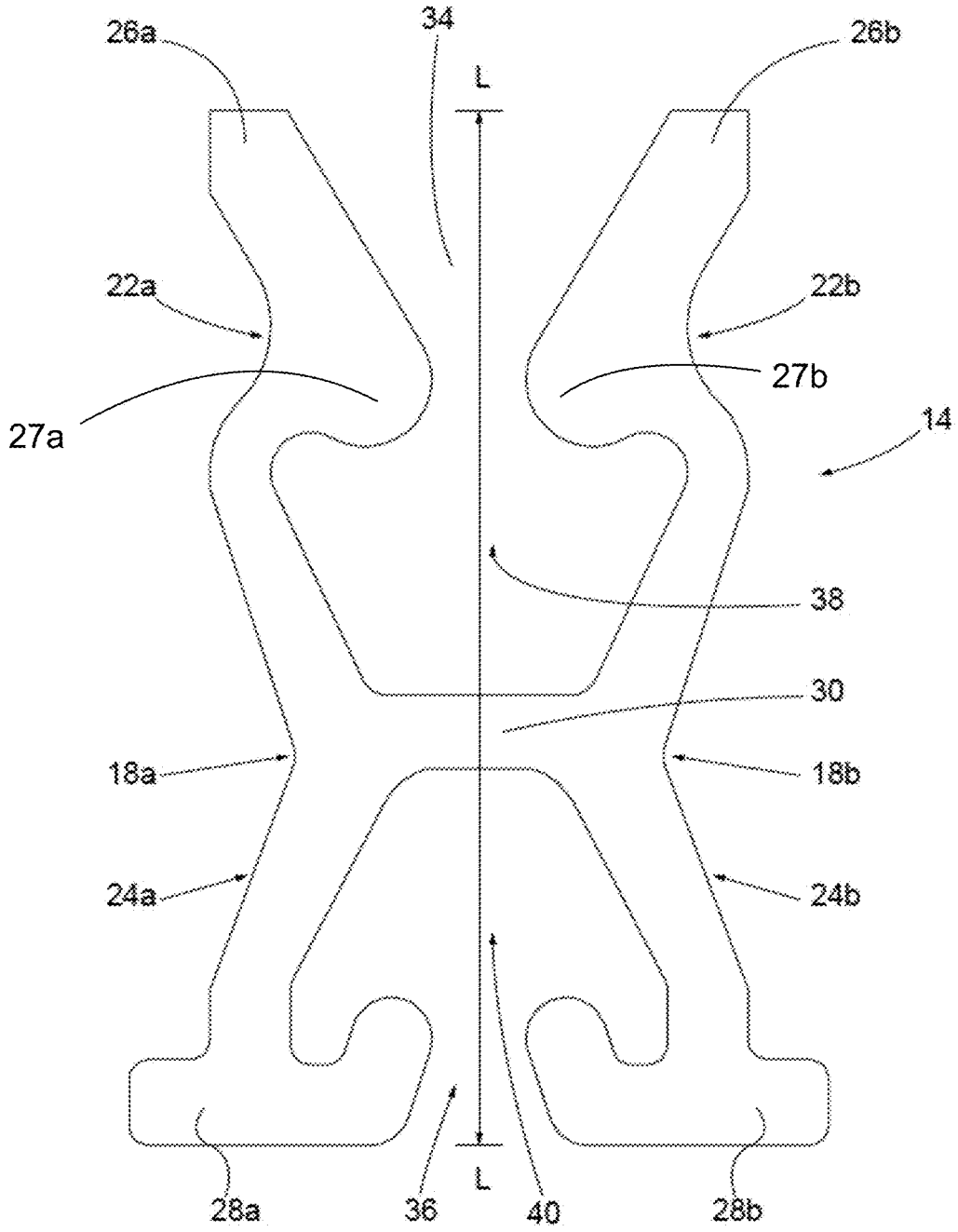
FIG. 3 shows a plan view of one of the contact plates.

Referring now to FIGS. 1 and 2, there is shown a coupler 10 constructed in accordance with this disclosure. The coupler 10 is comprised of a stack 12 of coupling contacts or contact plates 14 disposed in a housing 16. Each of the contact plates 14 is a unitary or monolithic structure and is electrically conductive, being composed of a conductive metal, such as a tin plated copper alloy. As best shown in FIG. 3, each contact plate 14 includes a pair of irregular-shaped elements or legs 18*a,b*. Each leg 18*a,b* includes an upper first portion 22*a,b* with a dog leg configuration and a lower second portion 24*a,b* with a generally L-shaped configuration. The first portion 22*a,b* includes a first end portion 26*a,b* with an inwardly-directed bulge 27*a,b*. The first end portion 26*a,b* angles outwardly, relative to a longitudinal center axis L of the contact plate 14, which extends between the legs 18*a,b*. The second portion 24*a,b* includes a second end portion 28*a,b* that extends laterally inward from an outer heel and then, towards the longitudinal center axis L, bends upward. The legs 18*a,b* are joined together by a cross bar 30, intermediate the first and second end portions 26*a,b*, 28*a,b*. The cross bar 30 extends laterally between the legs 18*a,b* and helps give the contact plate 14 a general H-shape. The first end portions 26*a,b* define a first receiving space 34 therebetween, while the second end portions 28*a,b* define a second receiving space 36 therebetween. Each of the first receiving spaces 34 has a wide outer portion and a narrow inner portion, thereby giving the first receiving space a general V-shape. Each of the second receiving spaces 36 is also V-shaped; however, the first receiving space 34 is larger and its V-shape is more pronounced than the second receiving space 36. The first receiving space 34 adjoins a first inner space 38, while the second receiving space 34 adjoins a second inner space 40.

As shown, the contact plates 14 are disposed serially, with their planar surfaces adjoining each other, to form the stack 12. However, in other embodiments, the contact plates 14 may be separated by spaces, respectively. The contact plates 14 are aligned with each other such that the first receiving spaces 34 form a first receiving groove 42 and the second receiving spaces 36 form a second receiving groove 44. Similarly, the first inner spaces 38 form a first inner passage 46 and the second inner spaces 40 form a second inner passage 48. The narrowest portion of the first receiving groove 42, which directly adjoins the first inner passage 46 and is formed by the narrow inner portions of the first receiving spaces 36, is referred to as the contact zone 49. The contact zone 49 extends between the bulges 27*a,b* of the contact plates 14. The first and second receiving grooves 42, 44 and the first and second inner passages 46, 48 extend in the stacking direction, which is normal to the planar surfaces of the contact plates 14. The number of contact plates 14 that are used is determined by the amount of electrical current the coupler 10 is designed to handle, with the current carrying capacity of the coupler 19 being increased by increasing the number of contact plates 14 used. Other factors that affect the current carrying capacity of the coupler 10 include the thickness of each contact plate 14, the type of plating used and the composition of the underlying metal structure.

The housing 16 is generally cuboid and is composed of an insulative material, such as plastic. The interior of the housing 16 is hollow and is sized to receive the stack 12 of contact plates 14 in a press fit operation, i.e., the interior is smaller in one or more dimensions than the stack 12. The housing 16 includes opposing first side walls 54*a,b*, opposing second side walls 50*a,b* and opposing first and second ends 58, 60, which are open. The second side walls 50*a,b* each have a rectangular major opening 62 disposed toward the first open end 58 and a rectangular minor opening 64 disposed toward the second end 60. The first side walls 54*a,b* each have a rectangular major slot 66 disposed toward the first open end 58 and a rectangular minor slot 68 disposed toward the second end 60. The minor slot 68 is defined by an abutment edge 69 that extends laterally between a pair of parallel edges 70. The abutment edge 69 is spaced inward from the second end 60.

The contact plates 14 are secured within the housing 16 in a press-fit operation in which the stack 12 as a whole is pressed into the housing 16 through the second open 60. The resulting interference fit between the stack 12 and the housing 16 secures the contact plates 14 within the housing 16, but permits pivoting motion of the contact plates 14, as will be discussed more fully later.

The contact plates 14 are disposed within the housing 16 such that the first receiving spaces 34 of the contact plates 14 are aligned with the first end 58 of the housing 16 and the second receiving spaces 36 of the contact plates 14 are aligned with the second end 60 of the housing 16. In addition, the first receiving groove 42 of the stack 12 is aligned with the major slots 66 in the housing 16 and the second receiving groove 44 of the stack 12 is aligned with the minor slots 68 in the housing 16.

For purposes of facilitating description, components of the coupler 10 may be described with regard to X, Y, Z spatial coordinates, which are as follows: the X-axis extends through the first side walls 54*a,b* of the coupler 10, the Y-axis extends through the second side walls 50*a,b* of the coupler 10, and the Z-axis extends through the first and second ends 58, 60 of the coupler 10.

The coupler 10 may be used in a variety of applications. In one application, the coupler 10 may be used to physically and electrically connect together two bus bars, with one bus bar being disposed in the first receiving groove 42 (and engaging the contact plates 14 therein) and the other bus bar being disposed in the second receiving groove 44 (and engaging the contact plates 14 therein). In another application (shown in FIG. 25), three of the couplers 10 arranged side-by-side may be used to physically and electrically connect together a pair of L-shaped metal plates 71, 73, with a short leg of the plate 71 being disposed in the first receiving grooves 42 of the couplers 10 (and engaging the contact plates 14 therein) and a short leg of the plate 73 being disposed in the second receiving grooves 44 of the couplers 10 (and engaging the contact plates 14 therein). The major slots 66 and the minor slots 68 in the housing 16 permit the coupler 10 to receive the bus bars from different angles or directions. For example, both the first receiving groove 42 and the second receiving groove 44 may receive a bus bar that is oriented with its longitudinal axis parallel to the X-axis of the coupler 10 or parallel to the Y-axis of the coupler 10. In this manner, the two bus bars connected by the coupler 10 can be arranged parallel to each other in the direction of the X-axis or the Y-axis, or arranged perpendicular to each other.

In another application, the coupler 10 may be used to electrically connect an edge connector of a PCB to a bus bar, an electrical/electronic device, or an edge connector of another PCB. The PCB edge connector may be disposed in the second receiving groove 44, while a bus bar, bar-like portion of the electrical/electronic device or an edge connector of the other PCB may be disposed in the first receiving groove 42.

Figure 4:
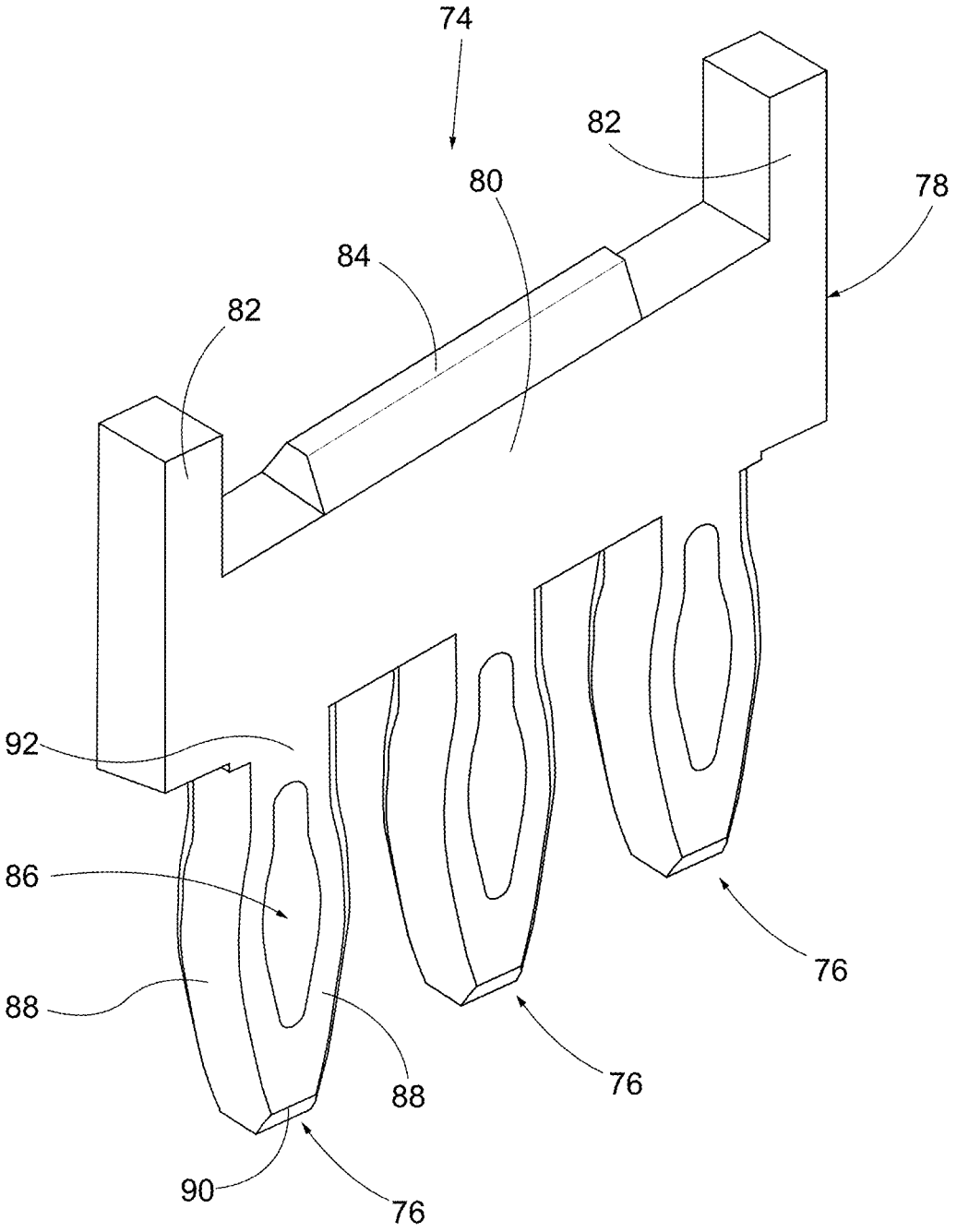
FIG. 4 shows a perspective view of a mounting contact for connection to the coupler.

In still another application, a mounting contact may be used to mount the coupler 10 to a substrate, such as a printed circuit board (PCB). Different embodiments of the mounting contact may be used, depending on the requirements of a particular application. One embodiment of the mounting contact (designated by the reference numeral 74) is shown in FIG. 4. The mounting contact 74 is a monolithic structure and is electrically conductive, being composed of a conductive metal, such as a tin plated copper alloy. The mounting contact 74 includes fastening structures 76 joined to a bar section 78. The bar section 78 is channel-shaped, having a center beam 80 joined between opposing, outwardly-extending arms 82. A blade 84 is joined to an upper portion of the beam 80 and has beveled surfaces that form an elongated edge. The blade 84 helps guide the beam 80 into the second receiving groove 44 and the second inner passage 48 of the stack 12 of contact plates 14.

The fastening structures 76 are joined to a lower portion of the beam 80 and extend outwardly therefrom, in a direction opposite the arms 82. Each fastening structure 76 may have an eye-of-the-needle (EON) type of press-fit construction. With this type of construction, each fastening structure 76 includes a center piercing 86 forming a pair of beams 88 that bow outwardly and are joined at an outer tip 90 and at an inner neck 92, which is joined to the beam 80. Each fastening structure 76 is adapted to be press-fit into a hole in a substrate, such as the plated hole in the PCB shown in FIG. 7. As the fastening structure 76 is being press-fit into the hole, the beams 80 initially deflect inward and then resiliently move outward to provide a normal force against the PCB hole, thereby providing a reliable physical and electrical connection.

The fastening structures used in the mounting contact 74 are not limited to having an EON-type of press fit construction. Instead, fastening structures having a different press-fit construction may be used, or the fastening structures may simply be elongated pins that are soldered into the holes of a PCB. In still another embodiment, the mounting contact 74 may have a single fastening structure that includes a mount joined to the beam 80, wherein the mount has a lower enlarged planar surface that may be sintered or soldered to a metal plate of an insulated metal substrate, such as a metal core printed circuit board.

Figure 5:
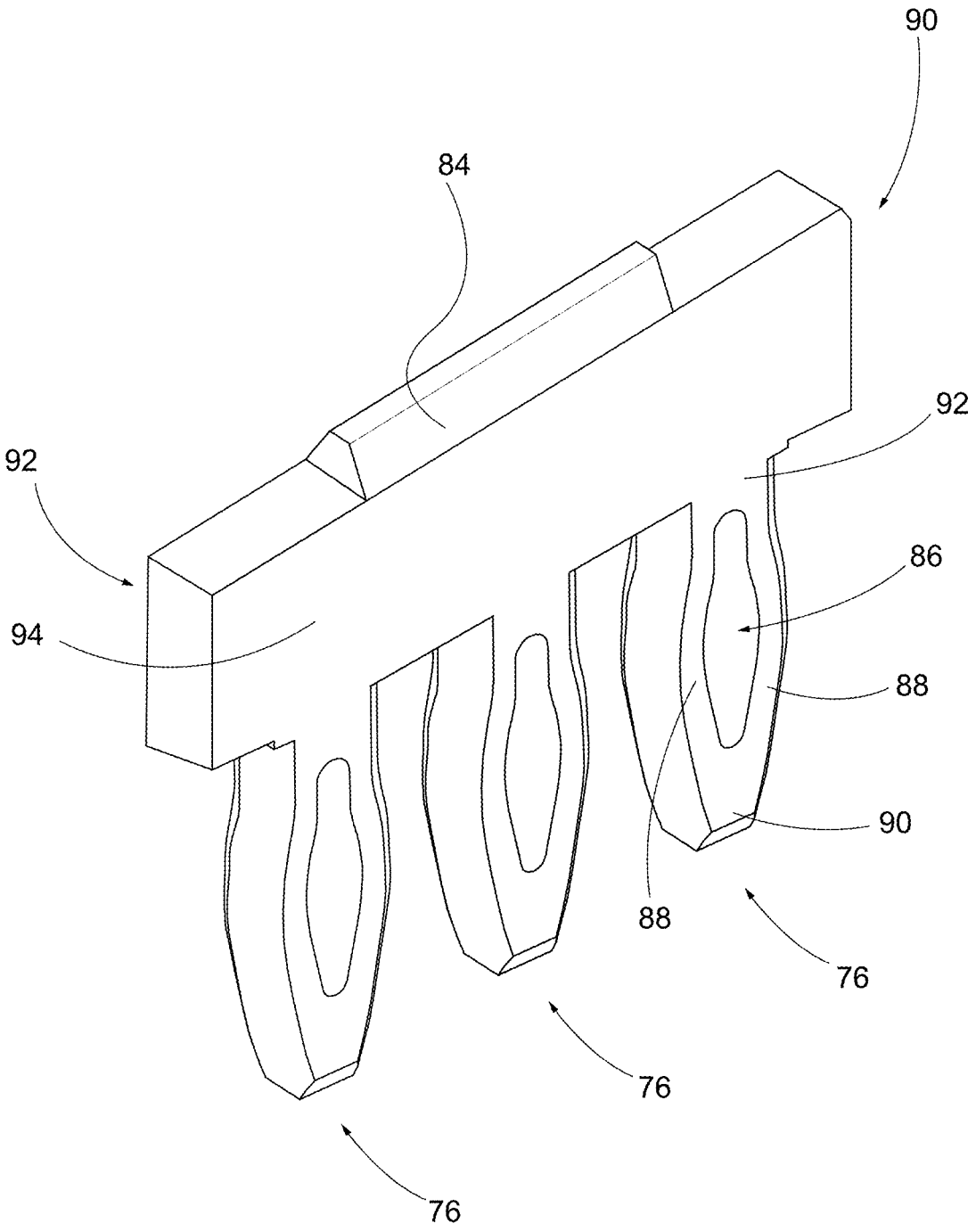
FIG. 5 shows a perspective view of a connecting contact for connection to a substrate.

The coupler 10 may be used with a connecting contact to connect together two substrates, such as two PCBs, especially when higher currents (30 amps or greater) are involved. Referring now to FIG. 5, such a connecting contact 90 is shown. The connecting contact 90 has the same construction as the mounting contact 74, except the connecting contact 90 has a bar section 92 that is different from the bar section 78. More specifically, the bar section 92 only has a center beam 94, without any outwardly-extending arms.

Figure 6:
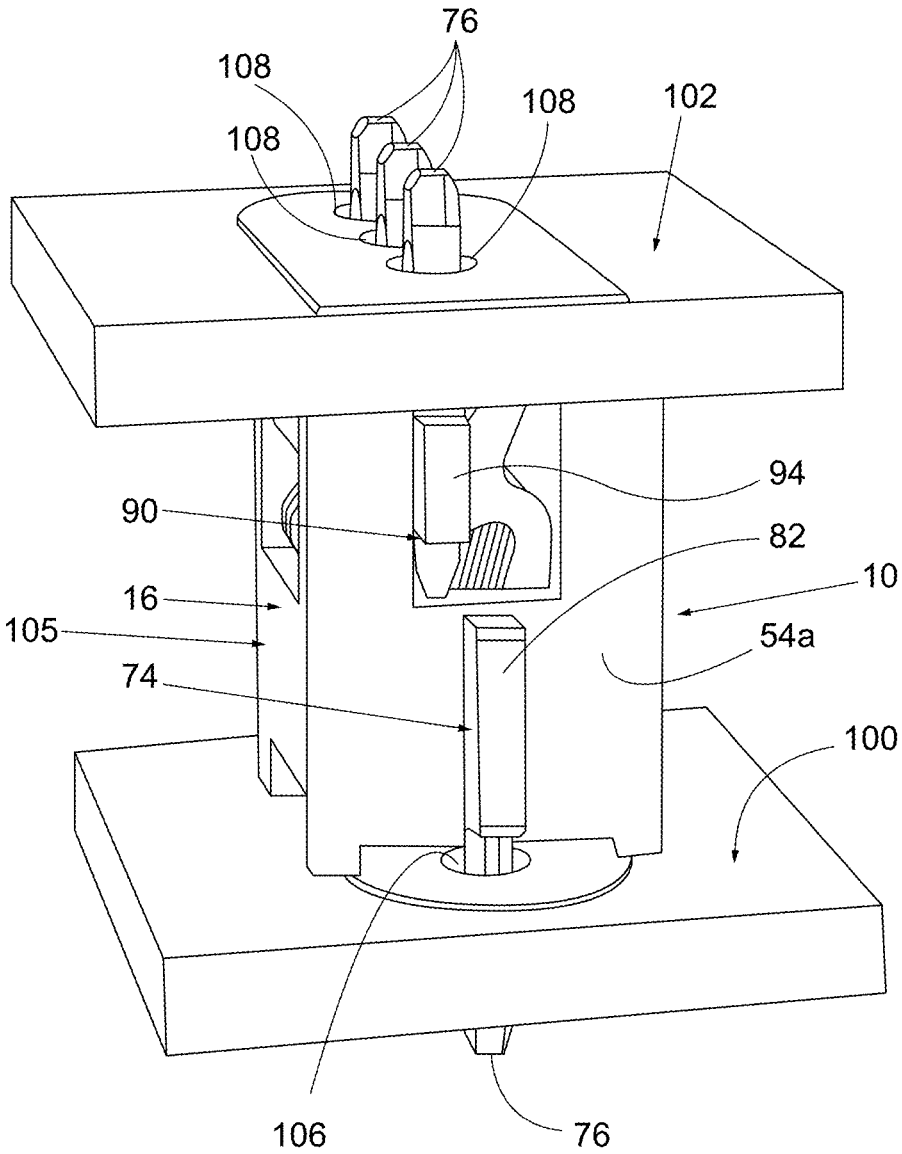
FIG. 6 shows a perspective view of a pair of printed circuit boards connected together by the coupler of FIG. 1, in combination with the mounting contact of FIG. 4 and the connecting contact of FIG. 5.
Figure 7:
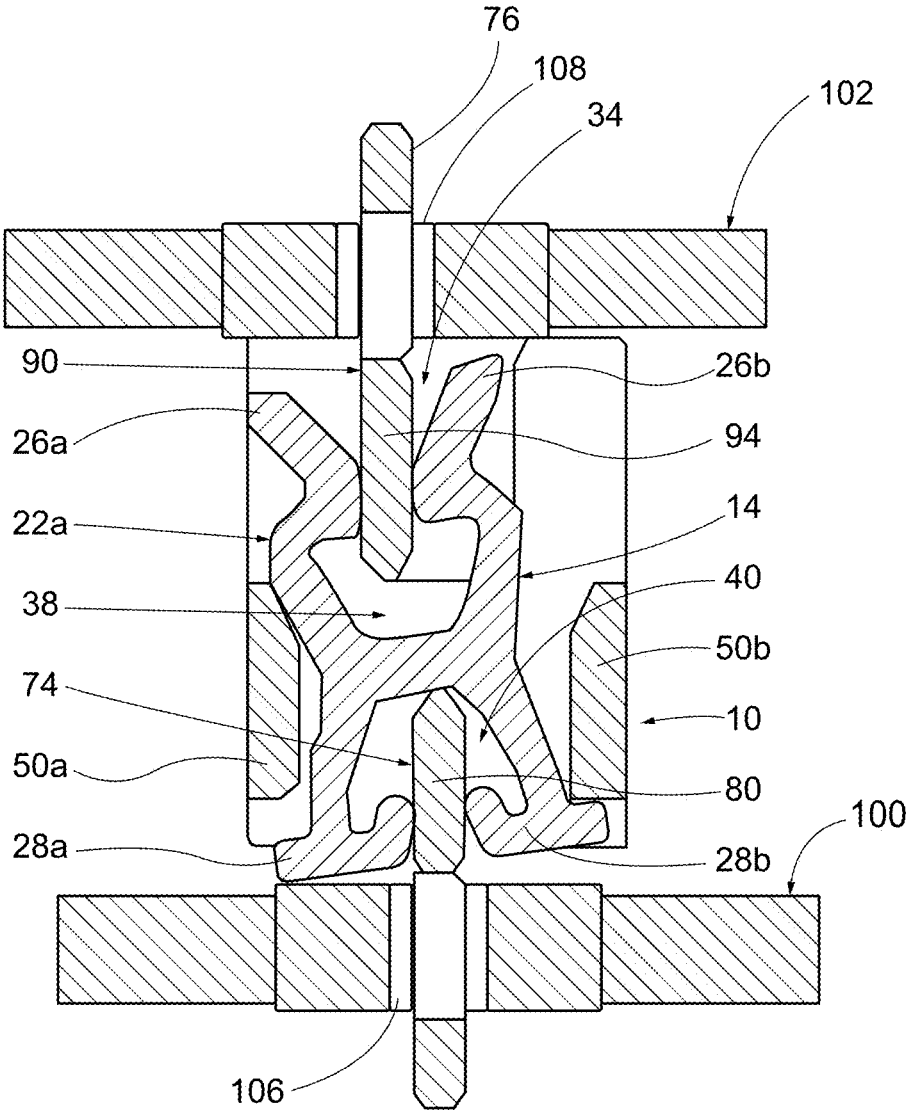
FIG. 7 shows a sectional view of the assembly of FIG. 6.

Referring now to FIGS. 6 and 7, the coupler 10, the mounting contact 74 and the connecting contact 90 are shown connecting together two PCBs 100, 102, each of which has a plurality of plated through-holes that are electrically conductive. The process of connecting together the PCBs 100, 102 begins with the coupler 10 and the mounting contact 74 being connected together and mounted to the PCB 100, and the connecting contact 90 being mounted to the PCB 102. In this regard, it is noted that the mounting contact 74 may be connected to the coupler 10 before or after the mounting contact 74 is secured to the PCB 102. However, the mounting contact 74 is typically connected to the coupler 10 before the mounting contact 74 is secured to the PCB 102. The PCB 102 is then connected to the PCB 100 by inserting the connecting contact 90 into the coupler 10.

The mounting contact 74 is secured to the coupler 10 by aligning the bar section 78 of the mounting contact 74 with the second receiving groove 44 of the coupler 10 and then applying a force to the mounting contact 74, while the coupler 10 is held still. The blade 84 guides the beam 80 into the second receiving groove 44 and the second inner passage 48 of the stack 12 of contact plates 14. The force is released when the beam 80 contacts the abutment edges 69 of the first side walls 54*a,b* defining upper ends of the minor slots 68. At this point, the beam 80 extends through both the second inner passage 48 and the second receiving groove 44 and adjoins the abutment edges 69 of the first side walls 54*a,b*. The arms 82 extend upward, beyond the abutment edges 69, and adjoin the first side walls 54*a,b*. In addition, the second end portions 28*a,b* of the contact plates 14 press against the beam 84, thereby electrically connecting the coupler 10 to the mounting contact 74. As will be discussed in more detail below, the combination of the coupler 10 and the mounting contact 74 forms a connector 105 that permits the PCB 100 to be connected to the PCB 102, even though the PCBs may be misaligned.

Since the PCB 102 and the PCB 100 are rigid bodies and they are to be connected with a low Z-space therebetween, there may be some misalignment in the Y-direction between the beam 94 and the first receiving groove 42. To better illustrate the operation of the connector 105, the beam 94 is shown as being offset to the left (as viewed from FIG. 7) from the longitudinal center axes L of the contact plates 14. The connector 105, however, accommodates this misalignment. As the beam 94 moves into the first receiving groove 42, the blade 84 contacts sloping inner surfaces of the first end portions 26*a* of the contact plates 14, which causes the contact plates 14 to pivot about the beam 80 (the X-axis) in a counterclockwise direction (as viewed from FIG. 7) and guide the beam 94 into the contact zone 49. The major opening 62 in the second side wall 50*a* permits this pivoting by receiving the first end portions 26*a* of the legs 18*a* of the contact plates 14. The pivotal movement of the contact plates 14 is shown in FIG. 7 and is about eight and a quarter degrees. Even though the contact plates 14 have pivoted out of their normal position, they still maintain a good physical and electrical connection with the beam 94, thereby establishing a good physical and electrical connection between the PCB 102 and the PCB 100. As shown in FIG. 7, the beam 94 is pressed between inner surfaces of the first end portions 26*a,b* of the contact plates 14 in the contact zone 49.

It should be appreciated that in addition to accommodating misalignment in the Y-direction, the connector 105 also accommodates misalignment in the X-direction and the Z-direction, as well as angular or twist misalignment in any of the three directions. The alignment of the the first receiving groove 42 with the major slots 66 permits the beam 94 to be offset in the X-direction vis-a-vis the first receiving groove 42 and still make a good physical and electrical connection with the contact plates 14. In the Z-direction, the beam 94 does not need to extend into the first inner passage 46 to the full extent possible to make a good physical and electrical connection.

Another advantage provided by the connector 105 is that it accommodates movement between parts that may occur after the parts have been connected. For example, the parts may move relative to each other due to environmental factors, such as temperature, vibration, impact or handling. The connector 105 permits this relative movement, while still maintaining a good electrical and physical connection between the parts.

In addition to being well suited to connect together two PCBs, the connector 105 is well suited to connect together other rigid electronic components. In particular, the attributes of the connector 105 make it especially well suited for connecting a bus bar to a PCB to supply power thereto. These attributes of the connector 105 include its small X-Y footprint, its ability to connect together misaligned rigid bodies and its ability to accommodate larger currents. Indeed, the current capacity of the connector 105 is scalable by changing the number of contact plates 14 used and/or changing the thickness, plating or structural composition of the contact plates 14. Current capacities of 30 amps or more are achievable. When used to connect a bus bar to a PCB, such as the PCB 100, an end or a portion of the bus bar is disposed within the first receiving groove 42 and the first inner passage 46 such that the enlarged planar surfaces of the bus bar engage the inner surfaces of the first end portions 26*a,b* of the contact plates 14 in the contact zone 49. Multiple connectors 105 may be used to mount a bus bar to a PCB.

Figure 8:
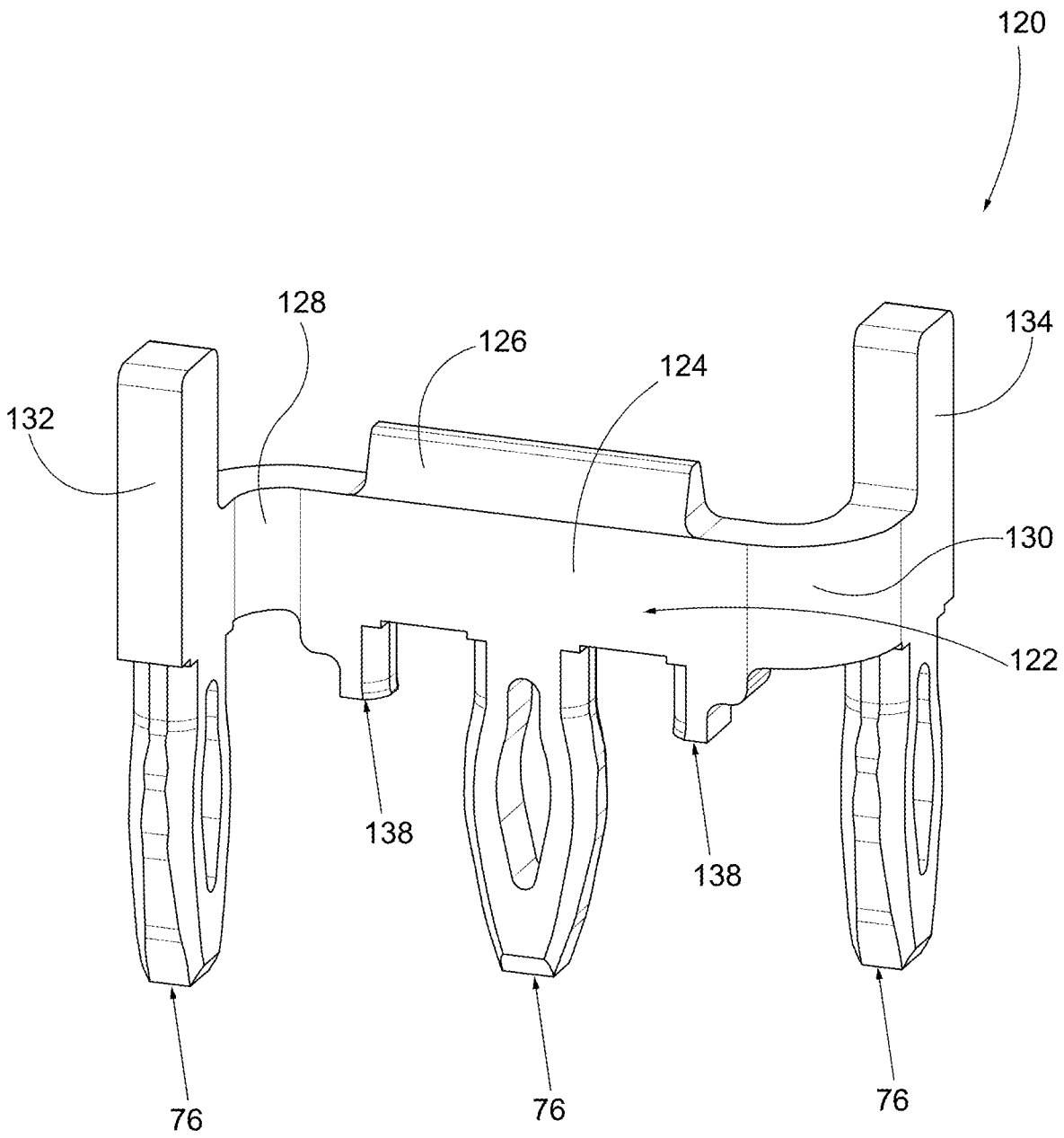
FIG. 8 shows a perspective of a lead frame for connection to the coupler of FIG. 1.

Depending on a particular connection between a PCB and bus bar, the connector 105 may be modified to provide more stability against rotating or tipping relative to the PCB as a result of the forces that may be applied by the bus bar. One such modification may be to replace the mounting contact 74 with a different type of mounting contact. For example, the mounting contact 74 may be replaced with the mounting contact or lead frame 120, which is shown in FIG. 8. The lead frame 120 is a monolithic, generally Z-shaped structure and is electrically conductive, being composed of a conductive metal, such as a tin plated copper alloy. The lead frame 120 has a bar section 122 with fastening structures 76 extending outwardly therefrom. The bar section 122 includes a center beam 124 having opposing ends joined by bends 128 130 to arms 132, 134, respectively. The bends 128, 130 curve in opposing directions to give the lead frame 120 its Z-shape. A blade 126 is joined to an upper portion of the beam 124 and has beveled surfaces that form an elongated edge. The arms extend upwardly beyond the blade 126. Two of the fastening structures 76 are joined to lower portions of the arms 132, 134, respectively, and extend downwardly therefrom. A third (or center) fastening structure 76 is joined to a lower portion of the beam 124 and extends downwardly therefrom. A pair of supports 138 are also joined to the lower portion of the beam 124 and extend downwardly therefrom. The supports 138 bracket the center fastening structure 76.

Figure 9:
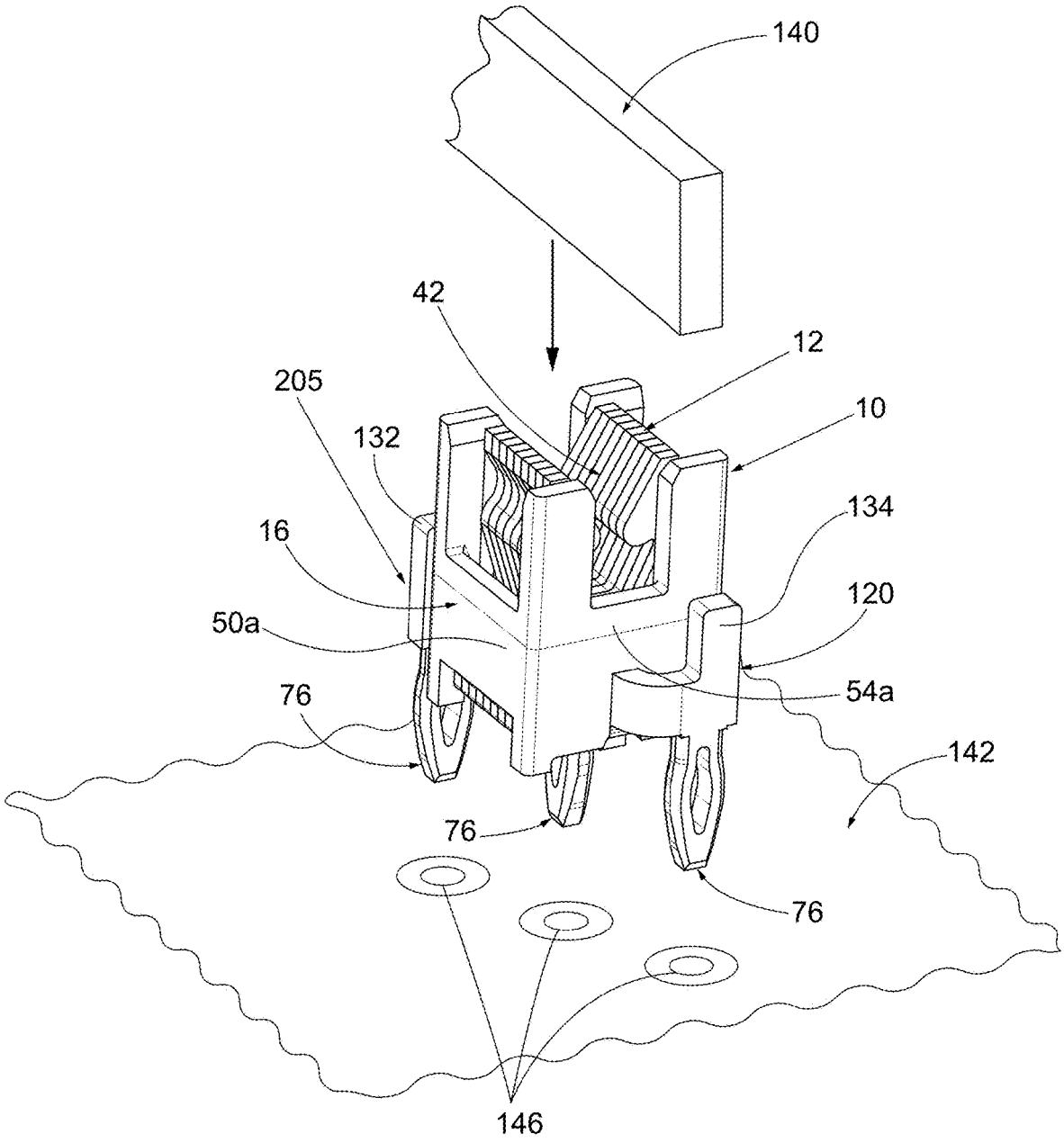
FIG. 9 shows a perspective view of a second connector formed by the coupler of FIG. 1 and the lead frame of FIG. 8, the second connector being disposed between a bus bar and a printed circuit board.

Referring now to FIG. 9, the lead frame 120 is shown mounted to the coupler 10 to form a connector 205, which helps physically and electrically connect a bus bar 140 to a PCB 142 to provide power thereto. Although not shown, multiple connectors 205 may be used to mount the bus bar 140 to the PCB 142. The lead frame 120 is mounted to the the coupler 10 by inserting the beam 124 into the second receiving groove 44 and the second inner passage 48 of the coupler 10. At the junctures with the bends 128, 130, the beam 124 also adjoins the abutment edges 69 of the first side walls 54*a,b* of the housing 16. With the beam 124 so positioned, the arms 132, 134 are disposed against the first side walls 54*a,b* of the coupler 10, respectively. However, the first arm 132 is positioned against the first side wall 54*b*, toward the second side wall 50*a*, while the second arm 134 is positioned against the first side wall 54*a*, toward the second side wall 50*b*.

In the connector 205, the fastening structures 76 are not arranged in the direction of the the X-axis, parallel to the second receiving groove 44, as in the coupler 105. Instead, the fastening structures 76 are arranged diagonal to the X-axis. Moreover, the fastening structures 76 are not all positioned with their widths (beam to beam) extending in the direction of the X-axis, as in the coupler 105. Instead, the outer fastening structures 76 are positioned with their widths extending in the direction of the Y-axis, while the middle fastening structure 76 (joined to the beam 124) is positioned with its width extending in the direction of the X-axis. When the connector 205 is mounted to the PCB 142 by press-fitting the fastening structures 76 into the plated holes 146 of the PCB 142, the foregoing arrangement of the fastening structures 76 helps prevent the connector 205 from pivoting about the X-axis and otherwise moving due to torsional and other forces applied by the bus bar 140. In this regard, it should be noted that when the connector 205 is mounted to the PCB 142, the supports 138 of the lead frame 120 contact the surface of the PCB 142 and help provide additional support for and stability to the connector 205.

It should be appreciated that the lead frame 120 in the connector 205 may be modified to have a different configuration. For example, instead of the bends 128, 130 curving in opposing directions, the bends 128, 130 may curve in the same direction, which would give the lead frame 120 a general U-shape. Still another example would be having only one of the bends 128, 130 so that the lead frame 120 has a general L-shape.

Figure 10:
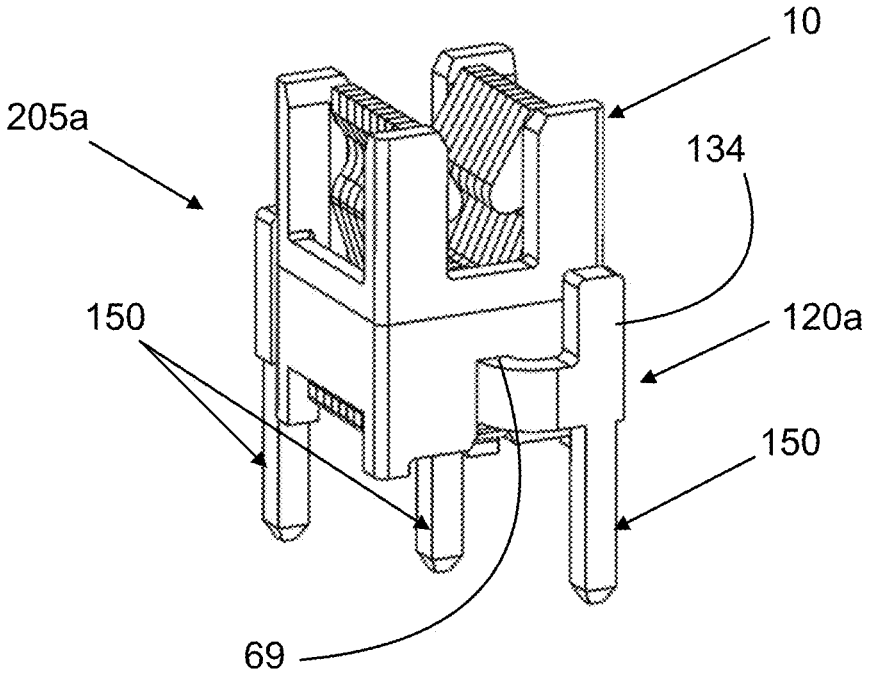
FIG. 10 shows a perspective view of a third connector formed by the coupler of FIG. 1 and a second lead frame.
Figure 11:
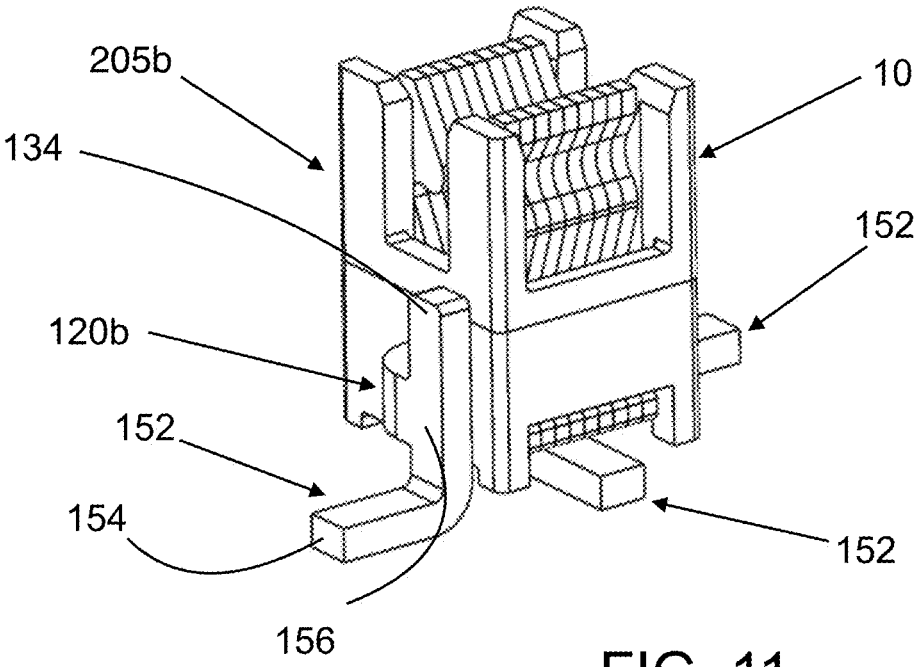
FIG. 11 shows a perspective view of a fourth connector formed by the coupler of FIG. 1 and a third lead frame.
Figure 12:
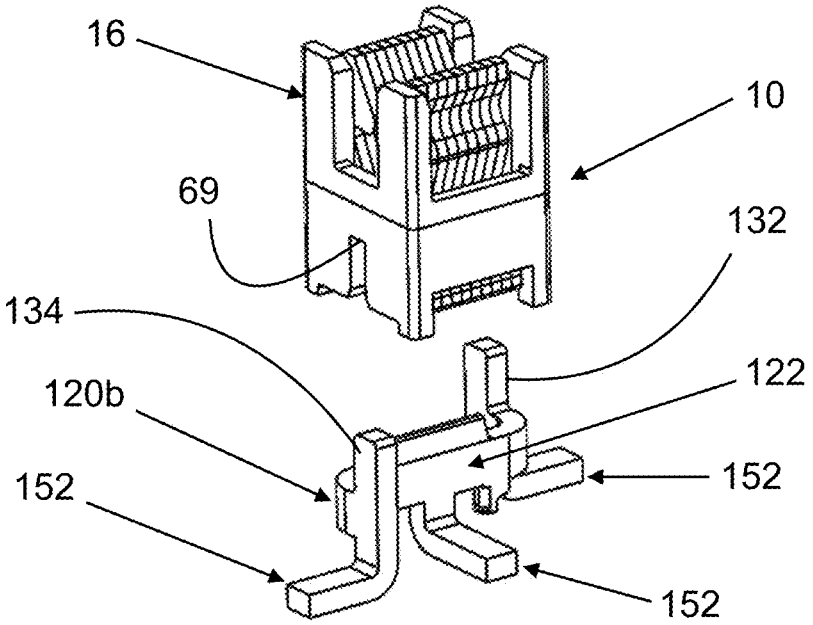
FIG. 12 shows a partially exploded view of the fourth connector of FIG. 11, with the coupler being separated from the third lead frame.

It should also be appreciated that the lead frame 120 in the connector 205 may be modified to have a greater or lesser number of fastening structures 76. In addition, other types of fastening structures may be used. For example, FIG. 10 shows a modified connector 205*a* with a modified lead frame 120*a* having elongated pins 150 in lieu of the fastening structures 76. In order to mount the connector 205*a* to a substrate with holes (such as a PCB), the pins 150 are inserted into the holes and soldered, respectively. Another example is shown in FIG. 11 in which a connector 205*b* has a modified lead frame 120*b*. As best shown in FIG. 12, the lead frame 120*b* has mounts 152 in lieu of the fastening structures 76. Each mount 152 is L-shaped and includes an elongated foot 154 joined at a bend to a short leg 156. The legs 156 are joined to, and extend from, the bar section 122. More specifically, two of the mounts 152 are joined to lower portions of the arms 132, 134, respectively, and extend downwardly therefrom, while a third (or center) mount 152 is joined to a lower portion of the beam 124 and extends downwardly therefrom. The foot 154 of the center mount 152 extends in the direction of the Y-axis, while the feet 154 of the other two mounts 152 extend in the direction of the X-axis, but are offset from each other. Bottom surfaces of the feet 154 are planar to facilitate their attachment, such as by soldering or sintering, to a metal plate of an insulated metal substrate, such as a metal core printed circuit board.

In one embodiment, pads or layers of a dry sintering compound comprising silver particles may secured to the bottom surfaces of the feet 154, respectively, by adhesive or by the application of pressure and partial sintering. In this embodiment, when the lead frame 120*b* is to be used for making a connection to a metal substrate, the lead frame 120*b* is first secured to the metal substrate by pressing the sintering compound layers on the feet 154 against the metal substrate and then heating the lead frame 120*b* and the metal substrate to an elevated temperature that sinters the sintering compound layers, thereby securing the lead frame 120*b* to the metal substrate. Once the lead frame 120*b* is secured to the metal substrate and the combination has sufficiently cooled, the coupler 10 is connected to the lead frame 120*b* by aligning the second receiving groove 42 of the coupler 10 with the bar section 122 of the lead frame 120*b* and then pressing the coupler 10 and the lead frame 120*b* together.

In the embodiment wherein the mounting contact 74 is modified to have a single mount with an enlarged planar surface, a pad or layer of a dry sintering compound may be secured to the enlarged planar surface by adhesive or by the application of pressure and partial sintering. The modified mounting contact 74 with the sintering compound may be secured by sintering to a metal substrate and then attached to the coupler 10, as described above with regard to the lead frame 120*b*.

As shown in FIG. 9, the connector 205 may be used to mount a bus bar to a PCB so that the enlarged planar surfaces and the short lateral edges of the bus bar are disposed perpendicular to the plane of the PCB, while the longitudinal edges of the bus bar are parallel to the plane of the PCB. In order to mount a bus bar to a PCB in orientations different than this, connectors constructed in accordance with other embodiments may be provided. These embodiments are described below.

Figure 13:
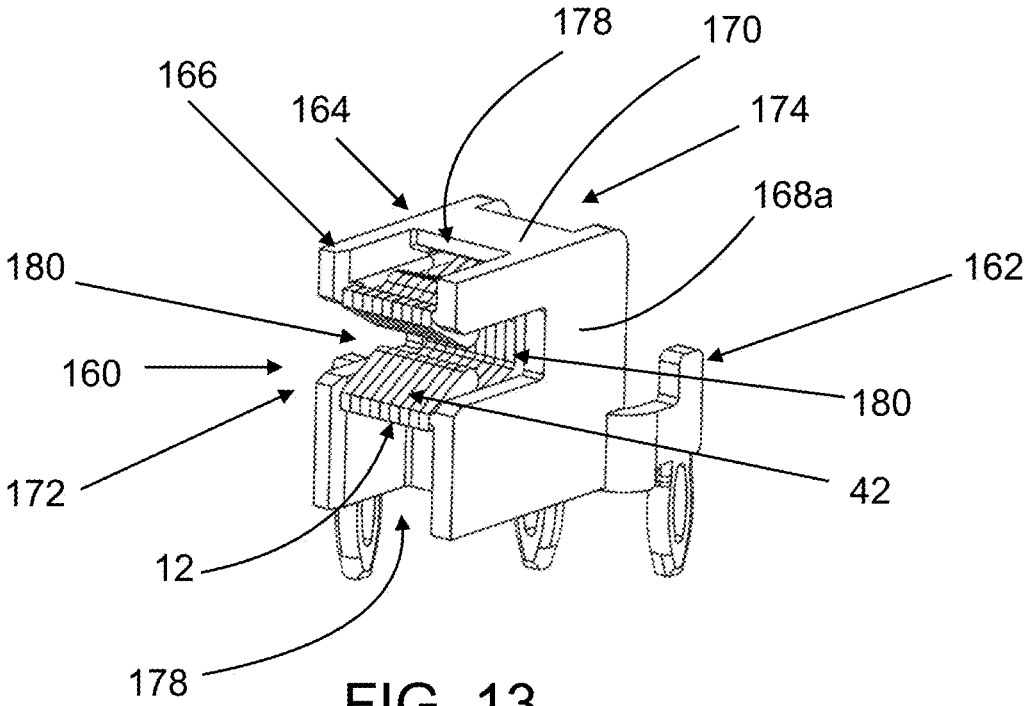
FIG. 13 shows a front perspective view of a fifth connector formed by a second coupler and a fourth lead frame.
Figure 14:
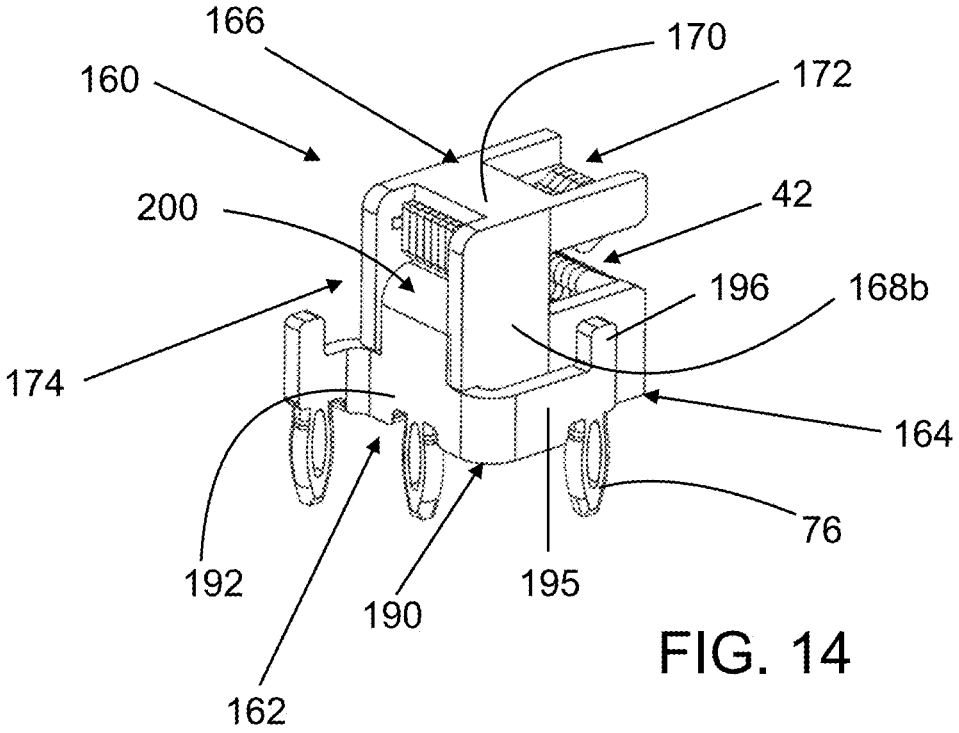
FIG. 14 shows a rear perspective view of the fifth connector.
Figure 15:
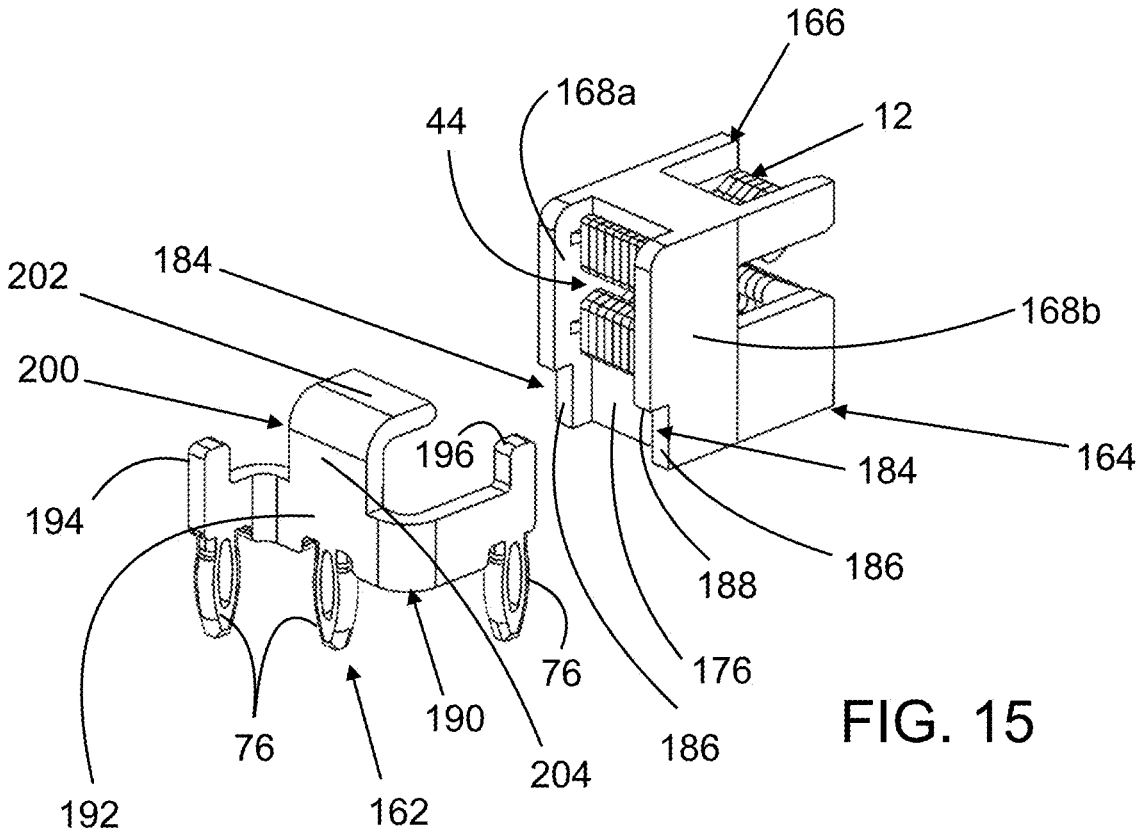
FIG. 15 shows a partially exploded rear perspective view of the fifth connector, with the second coupler being separated from the fourth lead frame.

Referring now to FIGS. 13-15, there is shown a connector 160 comprising a mounting contact or lead frame 162 connected to a coupler 164. The coupler 164 has a construction similar to that of the coupler 10; however the coupler 164 has a housing 166 instead of the housing 16. The housing 166 is generally cuboid and is composed of an insulative material, such as plastic. The interior of the housing 166 is hollow and is sized to receive the stack 12 of contact plates 14 in a press fit operation, i.e., the interior is smaller in one or more dimensions than the stack 12. The housing 166 includes opposing first side walls 168*a,b,* a second side wall 170 and opposing first and second ends 172, 174. The housing 166 defines an interior cavity, which is accessible through the first and second ends 172, 174. The first and second ends 172, 174 are open; however, an interior wall 176 is spaced inward from the second end 174. The second side wall 170 has a rectangular major opening 178 disposed toward the first end 172. Opposite the second side wall 170, the housing 166 is open, except for an edge of the interior wall 176. The first side walls 168*a,b* each have a rectangular major slot 180 disposed toward the first end 172 and a smaller notch 184 disposed toward the second end 174 (shown best in FIG. 15). Each notch 184 is formed by an abutment edge 186 disposed at about a right angle to another edge 188. The abutment edges 186 are spaced inward from the second end 174.

The stack 12 of the contact plates 14 are secured within the housing 166 in a press-fit operation in which the stack 12 as a whole is pressed into the housing 166 through the second end 174. The resulting interference fit between the stack 12 and the housing 166 secures the contact plates 14 within the housing 166, but permits pivoting motion of the contact plates 14.

The contact plates 14 are disposed within the housing 166 such that the first receiving spaces 34 of the contact plates 14 are aligned with the first end 172 of the housing 166 and the second receiving spaces 36 of the contact plates 14 are aligned with the second end 174 of the housing 166. In addition, the first receiving groove 42 of the stack 12 is aligned with the major slots 180 in the housing 166.

The lead frame 162 is a monolithic, generally Z-shaped structure and is electrically conductive, being composed of a conductive metal, such as a tin plated copper alloy. The lead frame 162 has a bar section 190 with fastening structures 76 extending outwardly therefrom. The bar section 190 includes a center beam 192 having an end joined by a bend to an arm 194 and another end joined by a bend and an extension 195 to an arm 196. The beam 192 extends through the notches 184 in the housing 166 and adjoin the abutment edges 186 thereof. The bends curve in opposing directions to give the lead frame 162 its Z-shape. The bar section 190 also includes an L-shaped member 200, which is joined to an upper portion of the beam 192. The member 200 comprises a tongue 202 joined at a bend to a base 204. The tongue 202 extends through the second receiving groove 44 and into the the second inner passage 48 of the coupler 164. The member 200 extends upwardly beyond the arms 194, 196. Two of the fastening structures 76 are joined to lower portions of the arms 194, 196, respectively, and extend downwardly therefrom. A third (or center) fastening structure 76 is joined to a lower portion of the beam 192 and extends downwardly therefrom. It should be appreciated that other fastening structures may be used in lieu of the fastening structures 76.

For example,the pins 150 or the mounts 152 may be used instead of the fastening structures 76.

Figure 16:
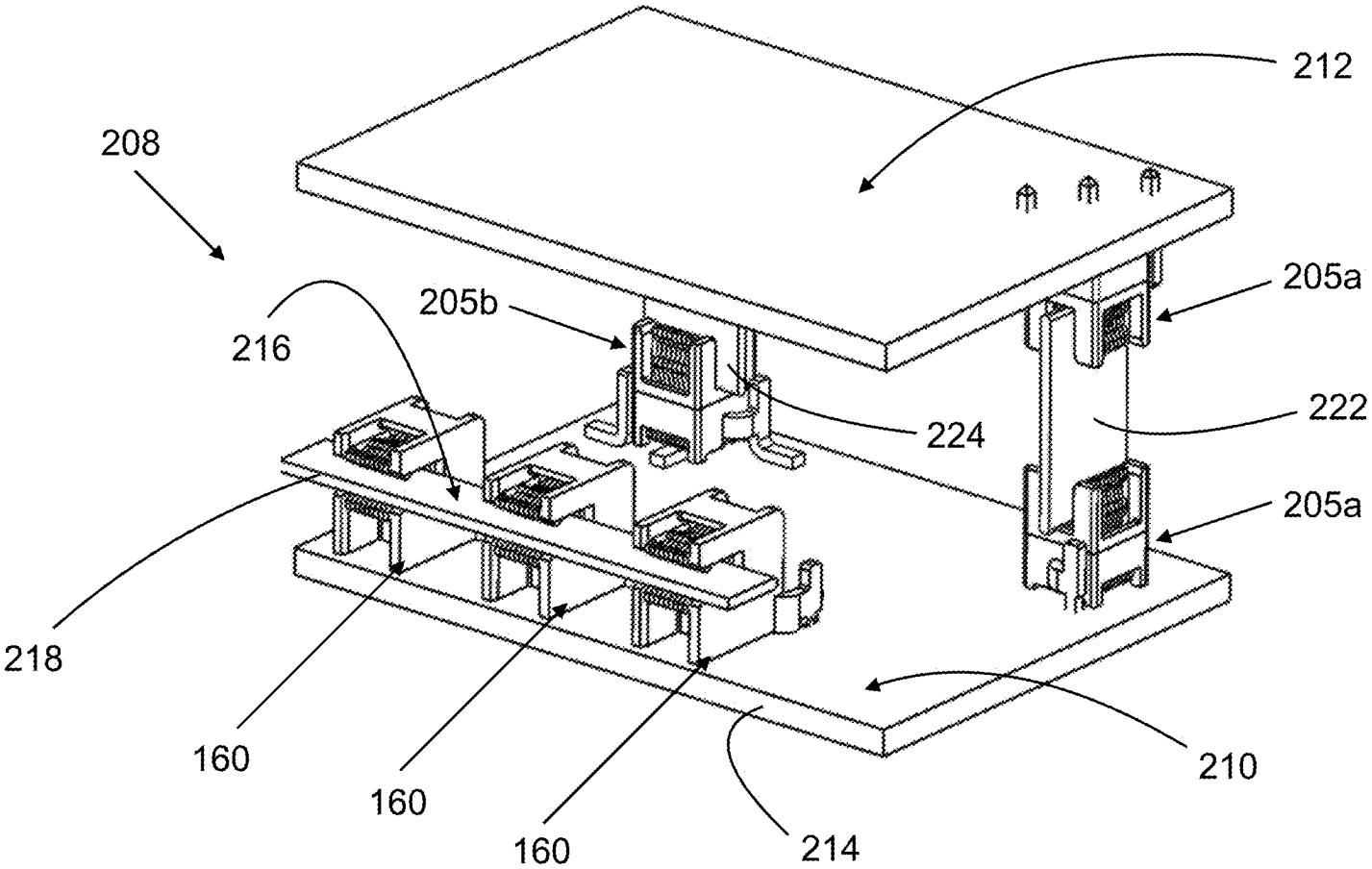
FIG. 16 shows a perspective view of an assembly comprising a pair of substrates, a plurality of third connectors, a plurality of fourth connectors and a plurality of fifth connectors.

The construction of the connector 160, with the fastening structures (76, etc.) each disposed at a right angle to the first receiving groove 42 provides a configuration that enables the connector 160 to mount a thin, flat structure (such as a power bus bar) to a substrate (such as a circuit board) such that the structure and the substrate are paralleled to each other. An example of this is shown in FIG. 16, to which reference is now made. An assembly 208 is shown comprising a pair of substrates 210, 212 having a plurality of different types of connectors mounted thereto, some of which connect substrates 210, 212 together. Three connectors 160 are shown mounted to the substrate 210, which may, by way of example, be a printed circuit board. The fastening structures 76 of each connector 160 are shown secured within holes (such as plated holes) formed in the substrate 210. The connectors 160 are spaced apart and arranged in a row located proximate to a first edge 214 of the substrate 210. The first receiving grooves 42 of the connectors 160 are aligned and face outwardly toward the first edge 214. A bar 216 (such as a power bus bar) extends into and through the aligned first receiving grooves 42. As shown, planar major surfaces of the bar 216 are disposed parallel to an upper surface of the substrate 210. An edge 218 of the bar 216 is aligned with the first edge 214 of the substrate 210. The bar 216 is composed of a conductive material, such as copper and, thus, makes electrical connections with the connectors 160, respectively.

The assembly 208 also includes a pair of connectors 205*a* that help connect the substrates 210, 212 together. A bottom one of the connectors 205*a* is mounted to the substrate 210, while a top one of the connectors 205*a* is mounted to the substrate 212. The pins 150 of the bottom one of the connectors 205*a* are soldered into plated holes in the substrate 210 and the pins 150 of the top one of the connectors 205 are soldered into plated holes in the substrate 212. The connectors 205*a* (and more specifically their first receiving grooves 42) face each other and are aligned. A metal bar 222 (such as a copper bus bar) extends vertically between the top and bottom ones of the connectors 205*a* and electrically connects them together. A top end of the bar 222 extends into the first receiving groove 42 and the first inner passage 46 of the top one of the connectors 205*a,* while a bottom end of the bar 222 extends into the first receiving groove 42 and the first inner passage 46 of the bottom one of the connectors 205*a*. The bar 222 may be installed, before the substrates 210, 212 are secured in postion relative to each other, by vertically inserting both (or one of) the top and bottom ends of the bar 222 through the first ends 58 of the housings 16 of the connectors 205*a* into the first receiving grooves 42 and the first inner passages 46. Alternately, the bar 222 may be installed, after the substrates 210, 212 are secured in postion relative to each other, by horizontally sliding the top and bottom ends of the bar 222 through the the major slots 66 of the housings 16 into the first receiving grooves 42 and the first inner passages 46 of the connectors 205*a*.

The assembly 208 also includes a pair of connectors 205*b* (only one of which is shown) that help connect the substrates 210, 212 together. A bottom one of the connectors 205*b* is mounted to the substrate 210, while a top one of the connectors 205*b* is mounted to the substrate 212. The feet 154 of the mounts 152 are secured by sintering or soldering to metal pads (not shown) of the substrates 210, 212, respectively. The connectors 205*b* (and more specifically their first receiving grooves 42) face each other and are aligned. A metal bar 224 (such as a copper bus bar) extends vertically between the top and bottom ones of the connectors 205*b* and electrically connects them together. A top end of the bar 224 extends into the first receiving groove 42 and the first inner passage 46 of the top one of the connectors 205*b,* while a bottom end of the bar 224 extends into the first receiving groove 42 and the first inner passage 46 of the bottom one of the connectors 205*b*. In the same manner as the bar 222 and the connectors 205*a,* the bar 224 may be installed before or after the substrates 210, 212 are secured in postion relative to each other.

As described above, the assembly 208 shows how connectors 160, 205*a,b* may be used to mount bus bars to a substrate so as to extend normal or parallel to the substrate, and also how they may be used to connect together two parallel substrates.

Figure 17:
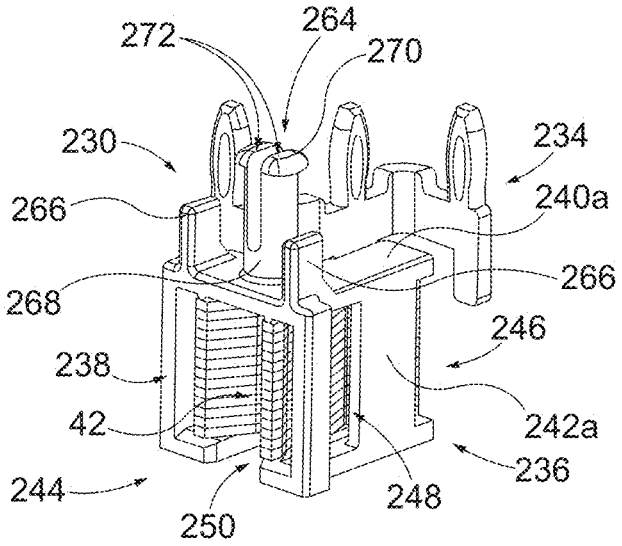
FIG. 17 shows a front perspective view of a sixth connector formed by a third coupler and a fifth lead frame.
Figure 18:
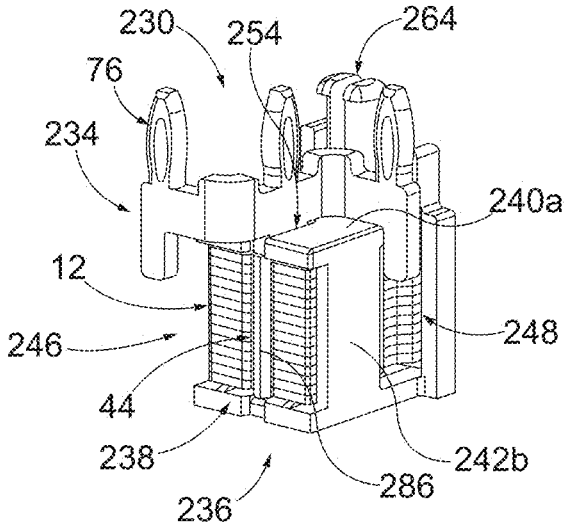
FIG. 18 shows a rear perspective view of the sixth connector.
Figure 19:
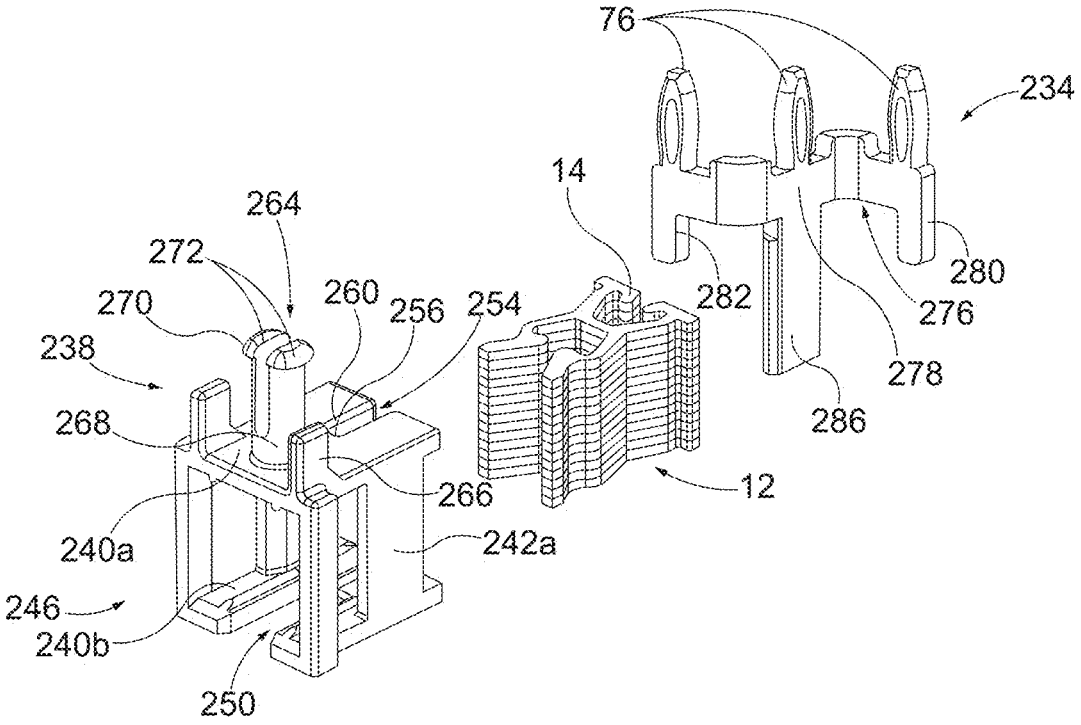
FIG. 19 shows a partially exploded front perspective view of the sixth connector.

Referring now to FIGS. 17-19, there is shown another connector 230 that is especially suited for mounting a bar to a substrate so as to extend perpendicular to the substrate. The connector 230 comprises a mounting contact or lead frame 234 connected to a coupler 236. The coupler 236 has a construction similar to that of the coupler 10; however the coupler 236 has a housing 238 instead of the housing 16. The housing 238 is generally cuboid and is composed of an insulative material, such as plastic. The interior of the housing 238 is hollow and is sized to receive the stack 12 of contact plates 14 in a press fit operation, i.e., the interior is smaller in one or more dimensions than the stack 12. The housing 238 includes opposing first side walls 240*a,b*, opposing second side walls 242*a,b* and opposing first and second ends 244, 246. The housing 238 defines an interior cavity that is accessible through the first and second ends 244, 246, which are open. The second side walls 242*a,b* each have a rectangular major opening 248 disposed toward the first end 244. The first side wall 240*b* has a rectangular major slot 250 disposed toward the first end 244, while the first side wall 240*a* has a minor slot 254 disposed toward the second end 246 (shown best in FIG. 19). The minor slot 254 is formed by an abutment edge 256 that extends laterally between a pair of parallel edges 260. The abutment edge 256 is spaced inward from the second end 246.

The housing 238 further includes a snap-fit projection 264 and a pair of supports 266 that are integrally joined to the first side wall 240*a* and extend outwardly therefrom. The snap-fit projection 264 and the supports 266 are located toward the first end 244, with the snap-fit projection 264 being at least partially disposed between the supports 266. The snap-fit projection 264 includes a cylindrical body 268 joined to a rounded head 270. A slot extends longitudinally through the head 270 and most of the length of the body 268 so as to form a pair of spaced-apart sections 272 having rounded head portions, respectively. The sections 272 are resiliently movable toward each other. As will be described more fully below, the snap-fit projection 264 is configured to be inserted into a mounting hole in a substrate, such as the substrate 274 (shown in FIG. 20).

The stack 12 of the contact plates 14 are secured within the housing 238 in a press-fit operation in which the stack 12 as a whole is pressed into the housing 166 through the second end 246. The resulting interference fit between the stack 12 and the housing 238 secures the contact plates 14 within the housing 238, but permits pivoting motion of the contact plates 14.

The contact plates 14 are disposed within the housing 238 such that the first receiving spaces 34 of the contact plates 14 are aligned with the first end 244 of the housing 238 and the second receiving spaces 36 of the contact plates 14 are aligned with the second end 246 of the housing 238. In addition, the first receiving groove 42 of the stack 12 is aligned with the major slot 250 in the housing 238.

The lead frame 234 is a monolithic, generally Z-shaped structure and is electrically conductive, being composed of a conductive metal, such as a tin plated copper alloy. The lead frame 234 has a bar section 276 with fastening structures 76 extending outwardly therefrom. The bar section 276 includes a center beam 278 having ends joined by bends to arm 280, 282, respectively. The bends curve in opposing directions to give the lead frame 234 its Z-shape. The bar section 276 also includes an elongated tab or tongue 286, which is joined to a lower portion of the beam 278. The tongue 286 extends through the minor slot 254 in the housing 238, as well as the second receiving groove 44 and the second inner passage 48 of the stack 12 of plates 14. Inside the minor slot 254, the tongue 286 adjoins the abutment edge 256 of the housing 238. Two of the fastening structures 76 are joined to upper portions of the arms 280, 282, respectively, and extend upwardly therefrom. A third (or center) fastening structure 76 is joined to an upper portion of the beam 278 and extends upwardly therefrom. It should be appreciated that other fastening structures may be used in lieu of the fastening structures 76. For example,the pins 150 or the mounts 152 may be used instead of the fastening structures 76.

Figure 21:
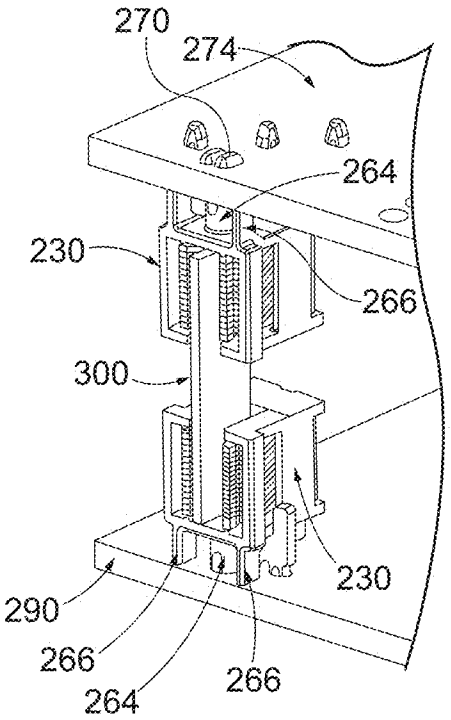
FIG. 21 shows the sixth connectors secured to the substrates, respectively, with the bar connected between the sixth connectors.
Figure 20:
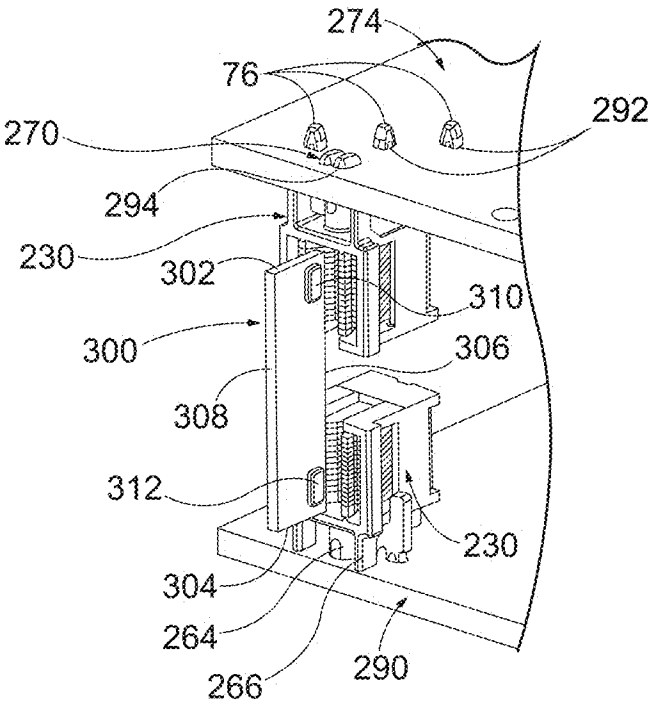
FIG. 20 shows a pair of the sixth connectors secured to a pair of substrates, respectively, with a bar in the process of being connected to the sixth connectors.

Referring now to FIGS. 20, 21, two of the connectors 230 are shown being used to connect a substrate 274 to a substrate 290. Each connector 230 is secured to its respective substrate (274, 290) by the fastening structures 76, as well as the snap-fit projection 264. In this regard, each substrate (274, 290) includes three holes 292 for the fastening structures 76 and a larger hole 294 for the snap-fit projection 264. The holes 294 have diameters that are smaller than the diameters of the heads 270. To mount each connector 230 to its substrate (274, 290), the connector 230 is positioned such that the fastening structures 76 are aligned with the holes 292, respectively, and the head 270 of the snap-fit projection 264 is aligned with the hole 294. When a force is applied to move the connector 230 and the substrate (274, 290) together, the beams 80 of the fastening structures 76 deflect inward to enter the holes 292 and the sections 272 of the snap-fit projection 264 deflect inward as their head portions contact an edge of the substrate (274, 290) defining the hole 294. The deflection of the sections 272 decreases the diameter of the head 270, which permits the head 270 to enter and pass through the hole 294, emerging on the other side of the substrate (274, 290), where the sections 272 resiliently move outward to return the head 270 to its original diameter. At this point, the substrate (274, 290) is trapped between the head 270 and the supports 266, which, together with the fasteninng structures 76, secure the connector 230 to the substrate (274, 290). In addition, the snap-fit projection 264 helps prevent the connector 230 from rotating relative to the substrate (274, 290). The supports 266 abut the substrate (274, 290) to further provide support and stability to the connection between the connector 230 and the substrate (274,290).

With the connectors 230 secured to the substrates 274, 290, as described above, a bar 300 (such as a bus bar) may be mounted to the connectors 230 to electrically and physically connect together the substrates 274, 290. The bar 300, which is composed of a conductive material (such as copper) is elongated and has first and second lateral edges 302, 304 and first and second longitudinal edges 306, 308. A pair of spaced-apart first and second retention dimples 310, 312 are formed in the bar 300, proximate to the first longitudinal edge 306. The first retention dimple 310 is located proximate to the juncture of the first longitudinal edge 306 with the first lateral edge 302, while the second retention dimple 312 is located proximate to the juncture of the first longitudinal edge 306 with the second lateral edge 304. The thickness of the bar 300 at the first and second retention dimples 310, 312 is greater than the width of the contact zones 49 in the connectors 230, which helps retain ends of the bar 300 in the connectors 230, as will be more fully discussed below.

Figure 22:
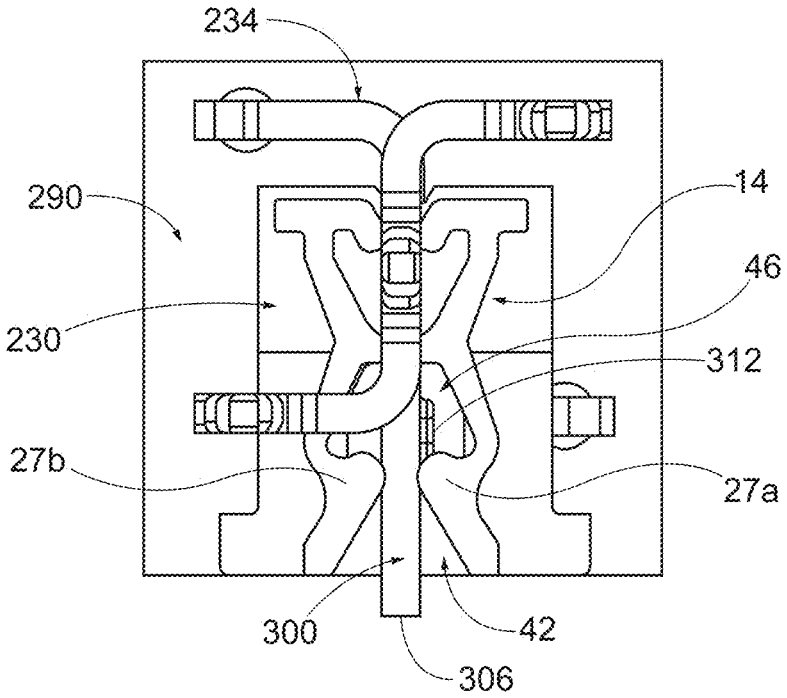
FIG. 22 shows a schematic sectional view of the connection of the bar to one of the connectors shown in FIG. 21.

In order to mount the bar 300 to the connectors 230, the substrates 274, 290 are first positioned to align the connectors 230 with each other. The bar 300, with the first longitudinal edge 306 facing the connectors 230 is then moved horizontally into the receiving grooves 42 of the connectors 230, respectively, through the first ends 244 and the major slots 250 of the housings 238. The bar 300 is further moved through the receiving grooves 42 and into the contact zones 49 of the connectors 230, respectively, thereby causing the first and second retention dimples 310, 312 to move the upper first portions 22*a,b* of the contact plates 14 outward, which allows the first and second retention dimples 310, 312 to move into the first inner passages 46, respectively. Once the first and second retention dimples 310, 312 are inside the first inner passages 46, the upper first portions 22*a,b* of the contact plates 14 move back inward, trapping the first and second retention dimples 310, 312 inside the first inner passages 46, respectively, as shown in FIG. 22. As a result, the bar 300 is secured to the connectors 230 and can only be removed by applying a pulling force to the bar 300 to move the first and second retention dimples 310, 312 back through the contact zones 49.

It should be appreciated that the bar 300 is not limited to use with the connector 230. Instead, the bar 300 may be used with any of the connectors disclosed herein (e.g., connectors 105, 160, 205, 230 etc.). Moreover, for a bar that is to be mounted to connectors with its lateral edges (instead of a longitudinal edge) inserted into the first receiving grooves 42 and the first inner passages 46, the bar may be provided with dimples located toward the lateral edges of the bar, as opposed to the longitudinal edge of the bar. Also, a bar may be provided with more than two dimples. For example, the bar 216 (shown in FIG. 16) may be provided with three dimples that are aligned with the three connectors 160, respectively.

It should also be appreciated that in lieu of providing a bar with protuberances to facilitate retention in the connectors of this disclosure, a bar may be constructed to have an overall thickness that is greater than the width of the contact zones 49 in the connectors. Such a bar would have depressions or holes instead of protuberances. In each connector, when the bar is inserted into the contact zone 49 between the bulges 27*a,b,* the bar would move the upper first portions 22*a,b* of the contact plates 14 outward until the depression or hole was located between the bulges 27*a,b,* at which point, the bulges 27*a,b* would move inward, to be partially disposed within the depression or hole. In this manner, the bulges 27*a,b* would retain the bar in the connector.

Figure 24:
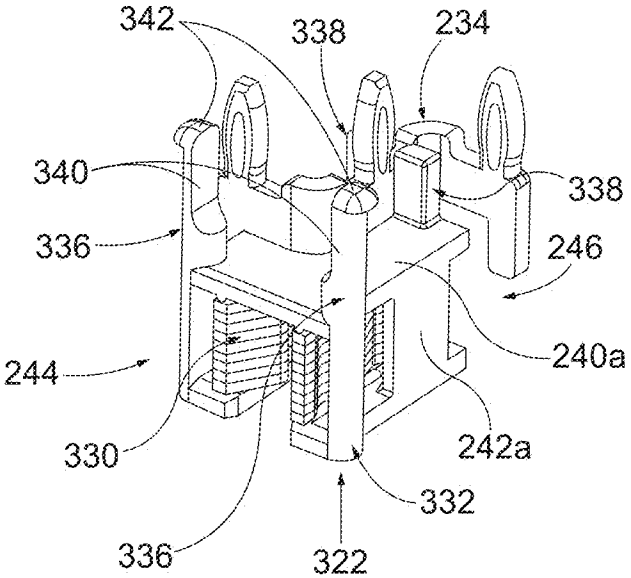
FIG. 24 shows a front perspective view of an eighth connector.
Figure 23:
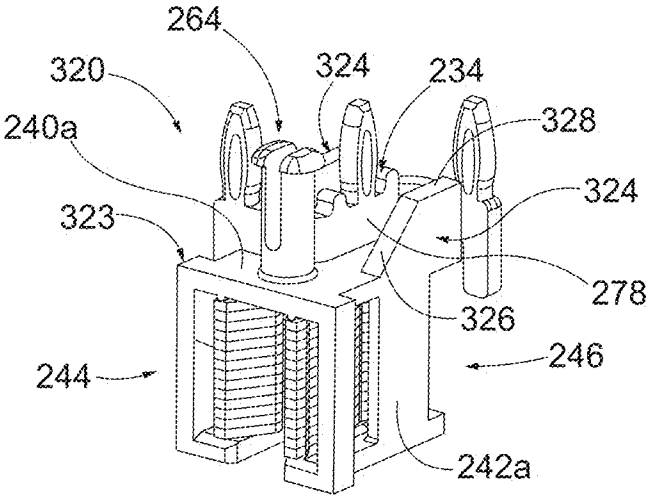
FIG. 23 shows a front perspective view of a seventh connector.

The connector 230 may be modified to have diffent variations. One such variation is connector 320 shown in FIG. 23 and another variation is connector 322 shown in FIG. 24.

The connector 320 has the same construction as the connector 230, except the connector 320 has a housing 323 with a pair of supports 324, instead of the supports 266. The supports 324 are integrally joined to the first side wall 240*a* and extend outwardly therefrom. Each support 324 has a sloping front edge 326 and a horizontal top edge 328 that abuts a substrate when the connector 320 is mounted to the substrate. Unlike the supports 266, the supports 324 are disposed toward the second end 246 of the housing 323. The beam 278 of the lead frame 234 and the minor slot 254 in the housing 322 are located between the supports 324.

The connector 322 differs from the connector 230 by having a stack 330 of plates 14 that is smaller than the stack 12 and a housing 332 that is smaller than the housing 238. In addition, the connector 322 has a pair of snap-fit connectors 336, instead of the single snap-fit connector 264, and has supports 338, instead of the supports 266. The snap-fit connectors 336 and the supports 338 are integrally joined to the first side wall 240*a* and extend upwardly therefrom. The snap-fit connectors 336 are disposed toward the first end 244 of the housing 332 and the second side walls 242*a,b,* respectively. Each snap-fit connector 336 has a resiliently deflectable upper body 340 joined to a partially rounded head 342. The upper bodies 340 are configured to deflect inward, towards each other, when pressed into holes in a substrate and then spring back when the heads 342 clear the holes on the other side of the substrate, trapping the substrate between the heads 342 and the supports 338. The supports 338 are disposed toward the second end 246 of the housing 332 and are spaced inward from the second side walls 242*a,b*. The beam 278 of the lead frame 234 and the minor slot 254 in the housing 322 are partially disposed between the supports 338. Top surfaces of the supports 338 abut a substrate when the connector 322 is mounted to the substrate.

Since the stack 330 of the connector 322 is smaller (i.e., has less plates 14) than the stack 12 of the connector 230, the connector 322 is constructed to carry less current than the connector 230. Indeed, in certain embodiments, the connector 322 has a current rating of 40 amps, while the connector 230 has a rating of 60 amps.

Figure 25:
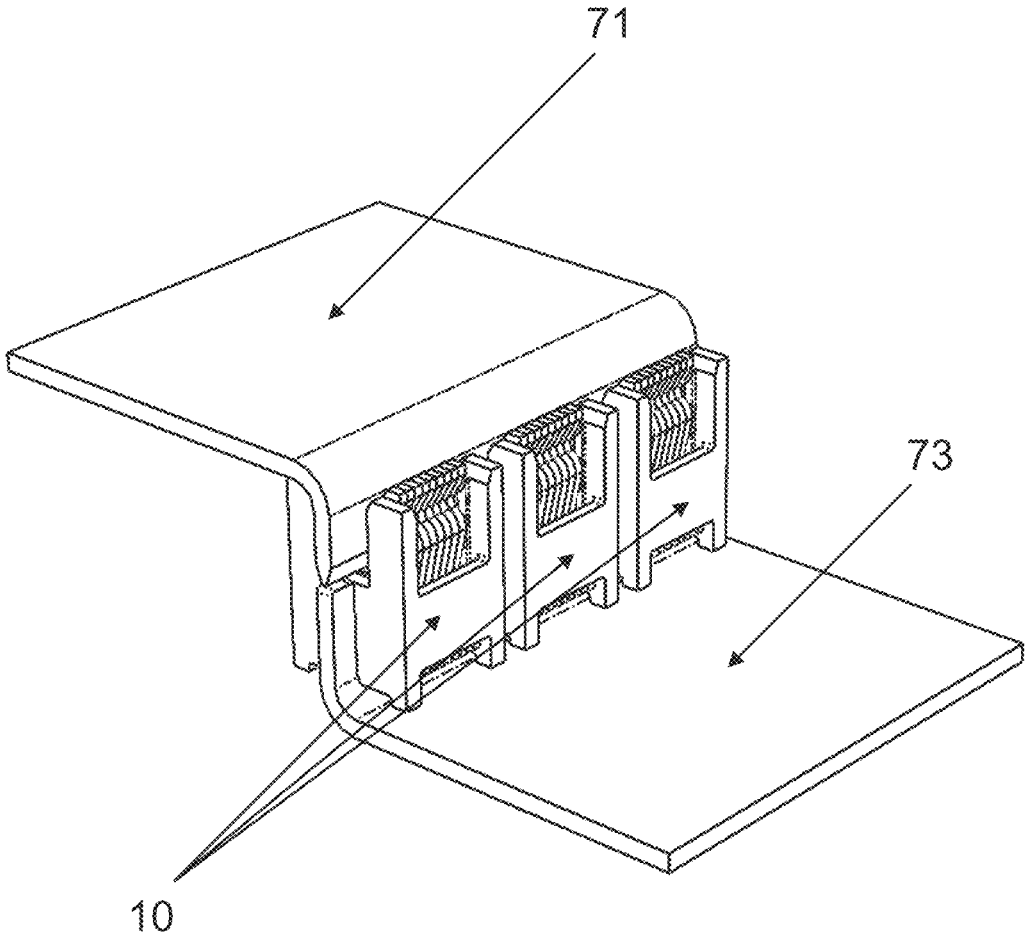
FIG. 25 shows three of the couplers of FIG. 1 connecting together a pair of plates.

In the embodiments described above, each of the couplers is shown as an individual unit having a single housing that contains a stack of coupling contacts or contact plates. While the couplers may be interconnected, such as by one or more bars or plates, as shown in FIG. 16 or FIG. 25, the couplers are not directly secured together. It should be appreciated that in other embodiments, however, a plurality of couplers may be directly secured together. For example a plurality of couplers may have their housings secured together to form a multiplex connector that connects a plurality of pairs of components together. The housings may be integrally joined together in a unitary molded plastic structure that serves to support and maintain the spatial relationship of the couplers. While their housings are secured together, the couplers each contain an individual stack of coupling contacts. The couplers may be of the same size and construction or may be of different sizes and constructions.

It is to be understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. A connector for connection to a substrate for mounting electronic devices and/or electrical devices, the connector comprising:

a housing having opposing first and second ends with openings, respectively, and a plurality of wall structures, at least a first one of the wall structures having an abutment surface located inwardly from the second end;

a plurality of coupling contacts disposed within the housing, each of the coupling contacts comprising a pair of elements having opposing first and second end portions, respectively, the elements in each pair being joined together, intermediate the first and second end portions, with the first end portions being separated by a first space and the second end portions being separated by a second space, the coupling contacts being arranged serially in the housing such that the first spaces are aligned to form a first receiving groove disposed at the first end of the housing and the second spaces are aligned to form a second receiving groove disposed at the second end of the housing; and a mounting contact extending into the housing and having a bar section joined to a fastening structure that is adapted for securement to the substrate, the bar section adjoining the abutment surface of the housing and being at least partially disposed in the second receiving groove formed by the coupling contacts.

2. The connector of claim 1, wherein the mounting contact comprises a plurality of fastening structures joined to the bar section, and wherein each of the fastening structures is resiliently deformable for press-fit insertion into a hole of the substrate.

3. The connector of claim 1, wherein the housing is composed of plastic and further comprises a snap-fit projection joined to the first one of the wall structures and extending outwardly therefrom, the snap-fit projection being adapted for securement within an opening in the substrate.

4. The connector of claim 3, wherein the housing further comprises a pair of spaced-apart supports joined to the first one of the wall structures and extending outwardly therefrom, the supports being shorter than the snap-fit projection and having surfaces, respectively, for abutment against the substrate.

5. The connector of claim 4, wherein the bar section comprises a beam joined to a tongue that extends into the second receiving groove, and wherein the tongue and the fastening structure extend in opposing directions.

6. The connector of claim 5, wherein the beam is at least partially disposed between the supports.

7. The connector of claim 6, wherein the housing further comprises a second snap-fit projection joined to the first one of the wall structures and extending outwardly therefrom, the second snap-fit projection being adapted for securement within a second opening in the substrate.

8. The connector of claim 1, wherein a second one of the wall structures has an abutment surface that is located inwardly from the second end of the housing, and wherein the bar section adjoins both of the abutment surfaces.

9. The connector of claim 8, wherein the first and second ones of the wall structures have inwardly-extending slots, respectively, that are partially defined by the abutment surfaces, respectively, the slots being aligned with the second receiving groove of the coupling contacts and the bar structure extending through the slots and adjoining both of the abutment surfaces of the wall structures.

10. The connector of claim 8, wherein the bar structure comprises arms connected by bends to opposing ends of a beam, respectively, the bends being oppositely directed such that the arms are disposed on opposing sides of the beam.

11. The connector of claim 10, wherein the beam extends through the second receiving groove, and wherein the arms are disposed adjacent to the first and second ones of the wall structures, respectively.

12. The connector of claim 10, wherein the bar section further comprises an L-shaped member that is joined to the beam and extends into the second receiving groove; and wherein in the first one of the wall structures, the abutment surface is disposed at about a right angle to another surface of the first one of the wall structures and cooperates therewith to define a first notch in the first one of the wall structures, wherein in the second one of the sidewalls, the abutment surface of the second one of the wall structures is disposed at about a right angle to another surface of the second one of the wall structures and cooperates therewith to define a second notch in the second one of the wall structures, and wherein the first and second notches are not aligned with the second receiving groove and the beam extends through the first and second notches.

13. An electrical assembly comprising the connector of claim 1, wherein the electrical assembly further comprises a circuit board substrate and a rigid structure, wherein the fastening structure of the connector is secured to the circuit board substrate and the rigid structure is disposed in the first receiving groove of the connector.

14. The electrical assembly of claim 13, wherein the circuit board substrate includes a metal pad, and wherein the fastening structure of the connector has a planar surface that is sintered or soldered to the metal pad.

15. The electrical assembly of claim 13, wherein the circuit board substrate has a plated hole, and wherein the fastening structure is securely disposed within the plated hole.

16. The electrical assembly of claim 15, further comprising a second circuit board substrate; and wherein the rigid structure is a bar of a connecting contact, which further includes a fastening structure secured to the second circuit board substrate.

17. The electrical assembly of claim 13, wherein the circuit board substrate has a hole and the housing further comprises a snap-fit projection that is joined to the first one of the wall structures and extends outwardly therefrom, and wherein the snap-fit projection is secured within the hole in the circuit board substrate.

18. A coupler for connecting a rigid structure to a substrate for mounting electronic devices and/or electrical devices, the coupler comprising:

a plastic housing having opposing first and second ends with openings, respectively, and a plurality of wall structures, a first one of the wall structures having a snap-fit projection joined thereto and extending therefrom, the snap-fit projection being adapted for securement within an opening in the substrate; and a plurality of coupling contacts disposed within the housing, each of the coupling contacts comprising a pair of elements having opposing first and second end portions, respectively, the elements in each pair being joined together, intermediate the first and second end portions, with the first end portions being separated by a first space and the second end portions being separated by a second space, the coupling contacts being arranged serially in the housing such that the second spaces are aligned to form a second receiving groove disposed at the second end of the housing and the first spaces are aligned to form a first receiving groove disposed at the first end of the housing, the first receiving groove being adapted to receive the rigid structure therein.

19. The coupler of claim 18, wherein the coupling contacts adjoin each other so as to form a stack, and wherein the elements of each coupling contact further comprise a pair of inwardly-directed bulges that define a narrow space that separates the first space from an inner space, and wherein the narrow spaces of the coupling contacts are aligned to define a contact zone and the inner spaces of the coupling contacts are aligned to define an inner passage; and wherein the contact zone and the inner passage of the coupling contacts are adapted to receive the rigid structure therein, with the coupling contacts making contact with the rigid structure in the contact zone.

20. The coupler of claim 18, wherein the housing further comprises a support joined to the first one of the wall structures and extending therefrom, the support being spaced from the snap-fit projection, and wherein the snap-fit projection extends out further from the first one of the wall structures than the support.

* * * * *